US010966490B2

(12) United States Patent
Sumiuchi et al.

(10) Patent No.: US 10,966,490 B2
(45) Date of Patent: Apr. 6, 2021

(54) FEMALE BUTTON AND COMBINATION OF FEMALE BUTTON AND MALE BUTTON

(71) Applicant: YKK Corporation, Tokyo (JP)

(72) Inventors: Eiji Sumiuchi, Tokyo (JP); Shoji Matsui, Tokyo (JP); Hayato Tadokoro, Tokyo (JP); Takahiro Kanno, Tokyo (JP)

(73) Assignee: YKK Corporation

( * ) Notice: Subject to any disclaimer, the term of this patent is extended or adjusted under 35 U.S.C. 154(b) by 21 days.

(21) Appl. No.: 16/484,244

(22) PCT Filed: Dec. 21, 2017

(86) PCT No.: PCT/JP2017/046007
§ 371 (c)(1),
(2) Date: Aug. 7, 2019

(87) PCT Pub. No.: WO2018/173397
PCT Pub. Date: Sep. 27, 2018

(65) Prior Publication Data

US 2019/0350317 A1 Nov. 21, 2019

(30) Foreign Application Priority Data

Mar. 23, 2017 (JP) ..... JP2017-058017

(51) Int. Cl.
*A44B 17/00* (2006.01)

(52) U.S. Cl.
CPC ..... *A44B 17/0076* (2013.01); *A44B 17/0011* (2013.01); *A44B 17/0041* (2013.01)

(58) Field of Classification Search
CPC ..... A44B 17/0011; A44B 17/0041
See application file for complete search history.

(56) References Cited

U.S. PATENT DOCUMENTS 2,644,214 A * 7/1953 Van Buren, Jr. ... A44B 17/0011 24/673
4,719,674 A * 1/1988 Kit ..... A44B 17/0011 24/108

(Continued)

FOREIGN PATENT DOCUMENTS

JP 2016-214569 A 12/2016
WO 2013/121650 A1 8/2013

OTHER PUBLICATIONS

International Search Report, PCT Application No. PCT/JP2017/046007, dated Mar. 20, 2018.

(Continued)

*Primary Examiner* — Jason W San
(74) *Attorney, Agent, or Firm* — Kilpatrick Townsend & Stockton LLP

(57) ABSTRACT

A female button is in an unlocked state when a rotator takes a first position and is in a locked state when the rotator takes a second position, insertion and removal of a post of a male button being allowed in the unlocked state, and insertion and removal of the post of the male button being hindered in the locked state. Arresting part or elastic member is provided with a projection which, when the rotator rotates toward the second position, displaces the arresting part toward the rotational axis before the rotator reaches the second position and, if the displacement of the arresting part toward the rotational axis is obstructed by the post, rotational resistance of the rotator is increased.

18 Claims, 19 Drawing Sheets

(56) References Cited

U.S. PATENT DOCUMENTS

| | | | | |
|---|---|---|---|---|
| 4,847,959 | A * | 7/1989 | Shimada | A44B 17/0011 24/671 |
| 5,101,541 | A * | 4/1992 | Watanabe | A44B 17/0011 24/114.4 |
| 5,259,096 | A * | 11/1993 | Grant | A44B 17/0011 24/324 |
| 5,375,302 | A * | 12/1994 | Takamura | A44B 17/0011 24/114.05 |
| 5,435,043 | A * | 7/1995 | Ito | A41H 37/04 24/114.4 |
| 9,756,930 | B2 * | 9/2017 | Hanchett | A45F 5/02 |
| 10,791,821 | B2 * | 10/2020 | Hanchett | A45F 5/02 |
| 2002/0029444 | A1 * | 3/2002 | Lyle | A44B 17/0041 24/621 |
| 2011/0016679 | A1 * | 1/2011 | Candotti | A44B 17/0088 24/700 |
| 2011/0113600 | A1 * | 5/2011 | Hasegawa | A44B 17/0041 24/594.11 |
| 2011/0283496 | A1 * | 11/2011 | Taniguchi | A44B 17/0041 24/697.1 |
| 2013/0117972 | A1 * | 5/2013 | Hasegawa | A44B 1/06 24/578.11 |
| 2014/0325797 | A1 * | 11/2014 | Hasegawa | A44B 17/0011 24/108 |
| 2015/0033507 | A1 * | 2/2015 | Brigato | A44B 17/0076 24/95 |
| 2015/0096156 | A1 * | 4/2015 | Brezzi | A44B 17/007 24/662 |
| 2015/0121667 | A1 * | 5/2015 | Humpert | B23P 19/064 24/687 |
| 2016/0316900 | A1 * | 11/2016 | Hanchett | A45F 5/02 |
| 2018/0344015 | A1 * | 12/2018 | Hanchett | A45F 5/02 |
| 2019/0116941 | A1 * | 4/2019 | Anderson | A44B 17/0064 |
| 2019/0281931 | A1 * | 9/2019 | Pferdehirt | A44B 17/00 |
| 2019/0307195 | A1 * | 10/2019 | Kanazawa | B21D 39/02 |
| 2019/0328120 | A1 * | 10/2019 | Hanchett | A45F 5/02 |
| 2019/0350317 | A1 * | 11/2019 | Sumiuchi | A44B 17/0047 |

OTHER PUBLICATIONS

International Preliminary Report on Patentability, PCT Patent Application No. PCT/JP2017/046007, mailed Oct. 3, 2019.

* cited by examiner

FEMALE BUTTON AND COMBINATION OF FEMALE BUTTON AND MALE BUTTON

TECHNICAL FIELD

The present disclosure is related to a female button and a combination of female and male buttons.

BACKGROUND ART

Patent literature 1 teaches in its FIG. 17, as described at para. 0085 of the specification thereof, a protrusion 70m5 is fitted with a recess 60m5 so that tactile sense of locking is obtained.

CITATION LIST

Patent Literature

[PTL 1] International Publication No. 2013/121650

SUMMARY

Technical Problem

Generation of tactile sense of locking unchangingly regardless of whether a post of a male button has been inserted to a female button or not would lead to misunderstanding that the female and male buttons are coupled even though they are uncoupled.

Solution to Problem

A female button according to an aspect of the present disclosure may be a female button which is in an unlocked state when a rotator takes a first position and which is in a locked state when the rotator takes a second position, insertion and removal of a post of a male button being allowed in the unlocked state, and insertion and removal of the post of the male button being hindered in the locked state, the female button including: at least one arresting part configured to arrest the post of the male button, radially outward displacement of the arresting part relative to a rotational axis of the rotator being allowed when the rotator takes the first position, and radially outward displacement of the arresting part relative to the rotational axis of the rotator is hindered when the rotator takes the second position; and at least one elastic member arranged radially outward of the at least one arresting part with respect to the rotational axis of the rotator. The arresting part or the elastic member is provided with a projection which, when the rotator rotates toward the second position, displaces the arresting part toward the rotational axis before the rotator reaches the second position and, if the displacement of the arresting part toward the rotational axis is obstructed by the post, rotational resistance of the rotator is increased.

In some embodiments, when the rotator rotates toward the first position, the rotational resistance of the rotator is increased before the rotator reaches the first position.

In some embodiments, the first position includes a single location only in a circumferential direction around the rotational axis, and the second position includes a single location only in the circumferential direction around the rotational axis.

In some embodiments, a plurality of arresting parts configured to arrest the post is provided as the at least one arresting part.

In some embodiments, the rotator has a fitting protrusion that is fitted with a recess configured by adjacent ends of the arresting parts in the circumferential direction around the rotational axis.

In some embodiments, when the rotator rotates toward the first position, the fitting protrusion pushes the elastic member radially outward before the rotator reaches the first position.

In some embodiments, the arresting part has at least one engagement protrusion, and the elastic member has at least one engagement recess with which the engagement protrusion is fitted.

In some embodiments, the projection is provided adjacent to the engagement recess.

In some embodiments, the elastic member has a thin portion extending in the circumferential direction around the rotational axis and being thinned radially with respect to the rotational axis so as to allow radially outward displacement of the arresting part in the unlocked state.

In some embodiments, the elastic member is a resin-made spring.

In some embodiments, a pair of arresting parts configured to arrest the post is provided as the at least one arresting part.

In some embodiments, the rotator is fitted with adjacent ends of the arresting parts in the circumferential direction around the rotational axis.

In some embodiments, the pair of arresting parts is formed by division of an annular part which is a combined part of the pair of arresting parts.

A set of buttons according to an aspect of the present disclosure may include a female button according to any one of ones described above; and a male button that has a post to be arrested by the arresting part of the female button.

Advantageous Effects of Invention

According to an aspect of the present disclosure, reduced would be a possibility of misunderstanding that the female and male buttons are coupled even though they are uncoupled. The present disclosure does not exclude concurrent use of other means for avoiding the misunderstanding.

BRIEF DESCRIPTION OF DRAWINGS

FIG. 1 is a schematic cross-sectional view taken along the line I-I in FIG. 3.

FIG. 2 is a schematic cross-sectional view taken along the line II-II in FIG. 3.

DESCRIPTION OF EMBODIMENTS

Hereinafter, non-limiting exemplary embodiments of the present invention will be described with reference to FIGS. 1 to 24. Disclosed one or more exemplary embodiments and respective features included in the exemplary embodiments are not mutually exclusive. A skilled person would be able to combine respective exemplary embodiments and/or respective features without requiring excess descriptions. Also a skilled person would appreciate synergistic effects of such combinations. Overlapping descriptions among the exemplary embodiments would be basically omitted. Referenced drawings are prepared for the purpose of illustration of invention, and may possibly be simplified for the sake of convenience of illustration.

Plural features described for one device or method may be understood as combination of features, but may be understood to include an independent feature independent to other features. Independent feature would be understood to be effective not only to the disclosed one device or method but also to undisclosed other devices or methods. Independent feature could be understood as combination with other different one or more features. Recitation of all combination of features is redundant to a skilled person, and thus omitted.

In the present specification, an individual feature will be clearly distinguished from other descriptions by phrases such as "In some embodiments", "In some cases", and "In some examples".

In the following descriptions, a direction that is parallel with a rotational axis AX of a rotator 140 would be referred to as up-down direction. It is not necessary that the up-down direction matches a vertical direction. Radial direction would be understood on the basis of the rotational axis AX in the most part of the following descriptions. "Radially inward" indicates a direction directed toward the rotational axis AX in a plane orthogonal to the rotational axis AX. "Radially outward" indicates a direction directed away from the rotational axis AX in a plane orthogonal to the rotational axis AX.

Figure 1:
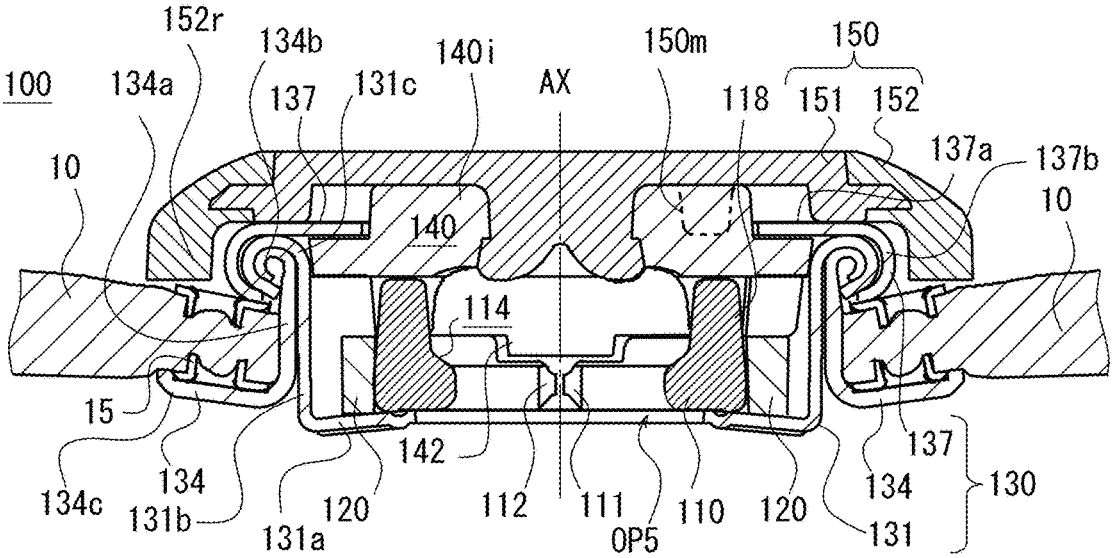
FIG. 1 is schematic cross-sectional view of a female button in unlocked state according to a non-limiting aspect of the present disclosure. Rotator is at a first position and allows insertion and removal of a post of a male button.
Figure 2:
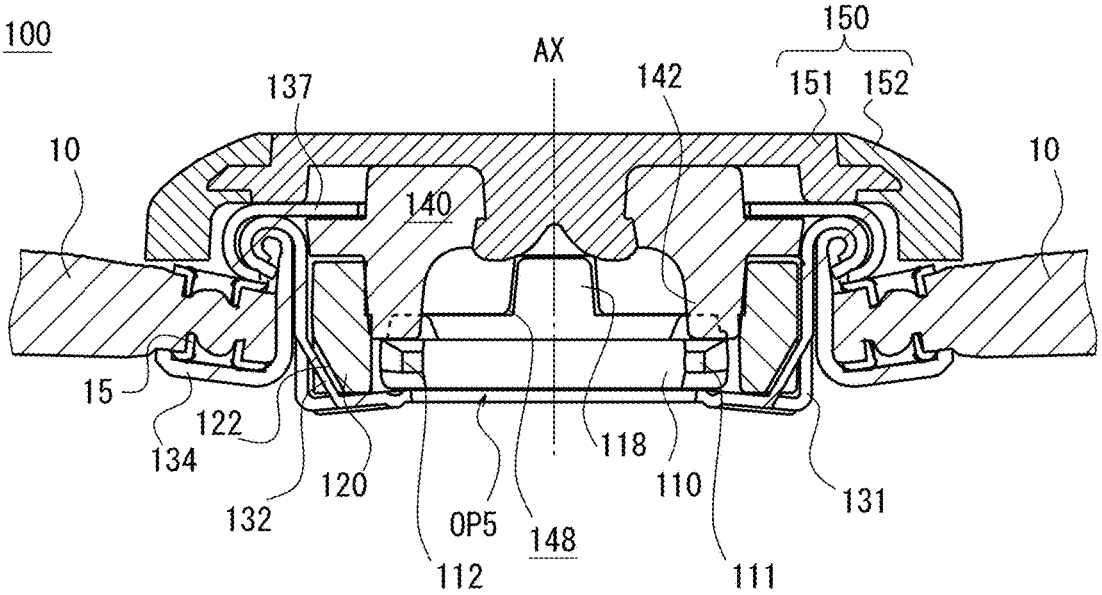
FIG. 2 is a schematic cross-sectional view of a female button in locked state according to a non-limiting aspect of the present disclosure. Rotator is at a second position and prohibits insertion and removal of a post of a male button.
Figure 3:
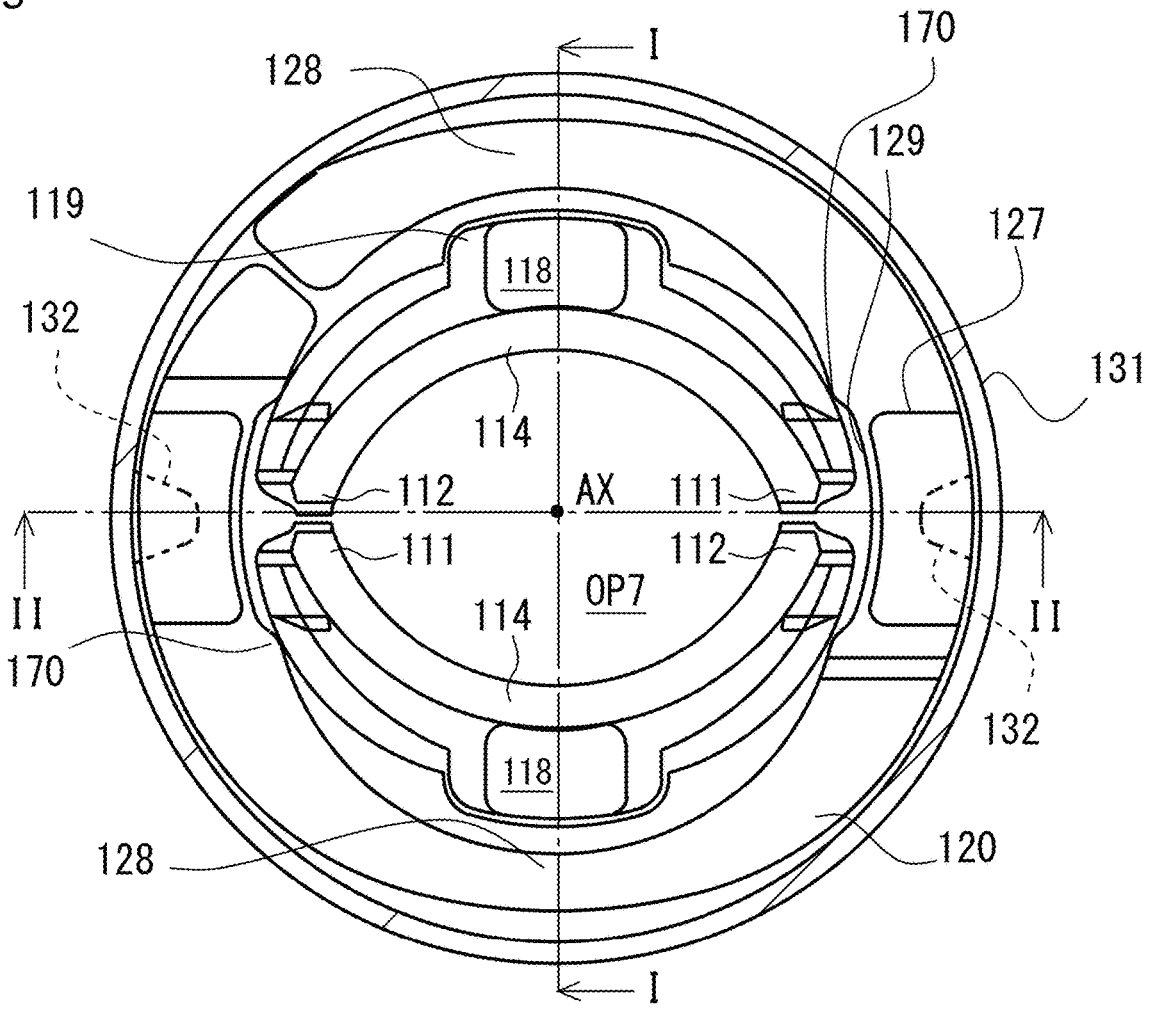
FIG. 3 is a diagram showing relative position of arresting parts and elastic member in a female button in unlocked state according to a non-limiting aspect of the present disclosure. The elastic member is provided radially outward than the arresting part from a rotational axis of a rotator. The elastic member allows radially outward displacement of the arresting parts.
Figure 4:
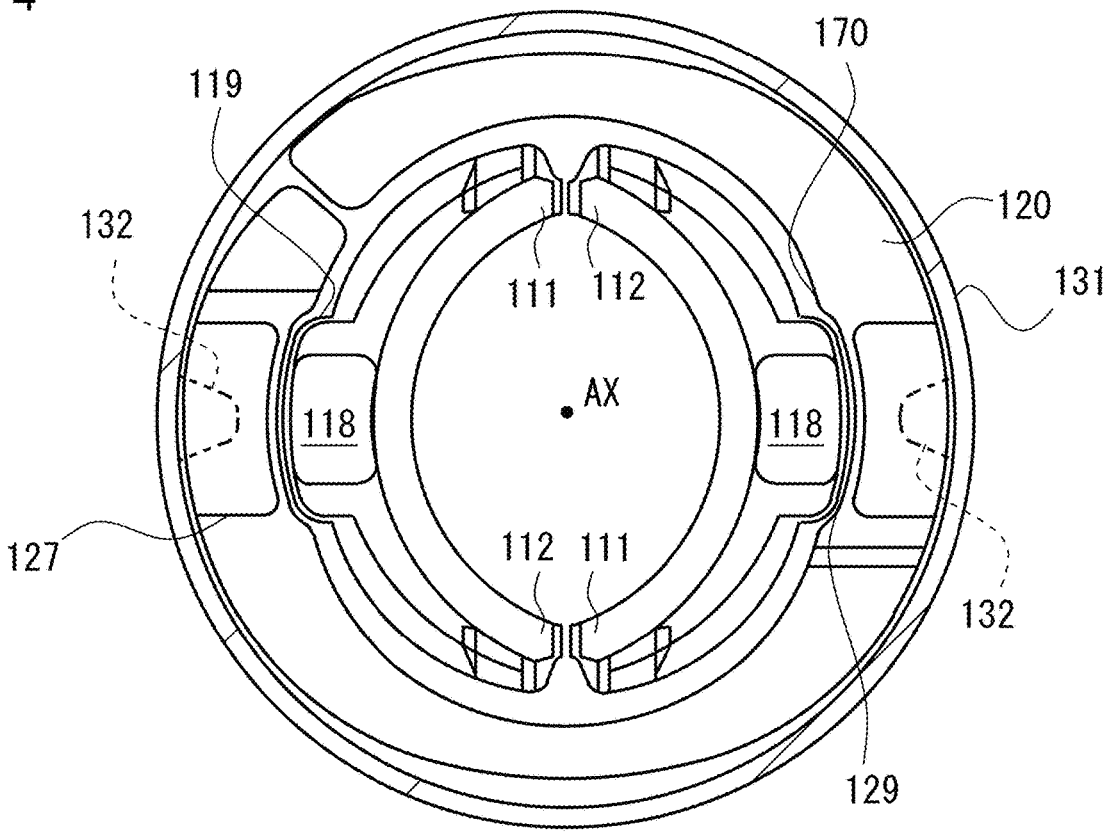
FIG. 4 is a diagram showing relative position of arresting parts and elastic member in a female button in locked state according to a non-limiting aspect of the present disclosure. The elastic member obstructs radially outward displacement of the arresting parts.
Figure 5:
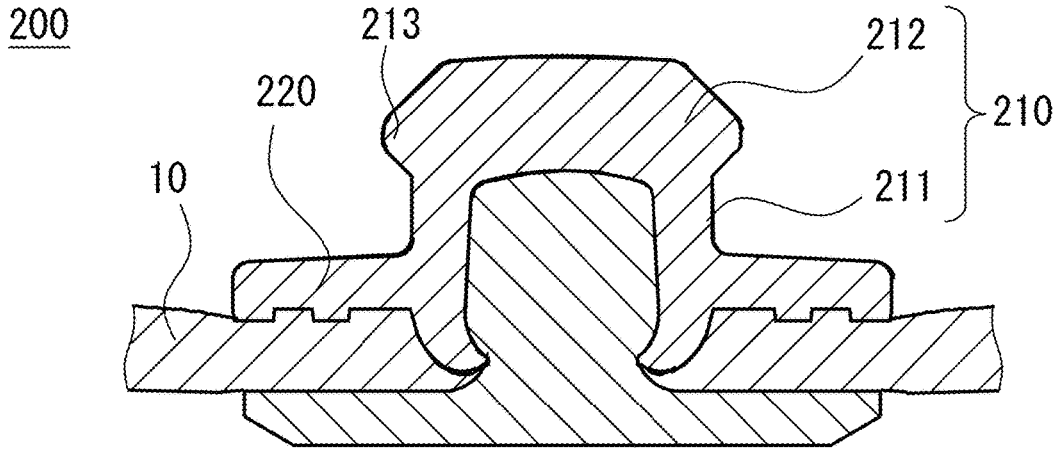
FIG. 5 is a schematic cross-sectional view of a male button used in combination with a female button according to a non-limiting aspect of the present disclosure.
Figure 6:
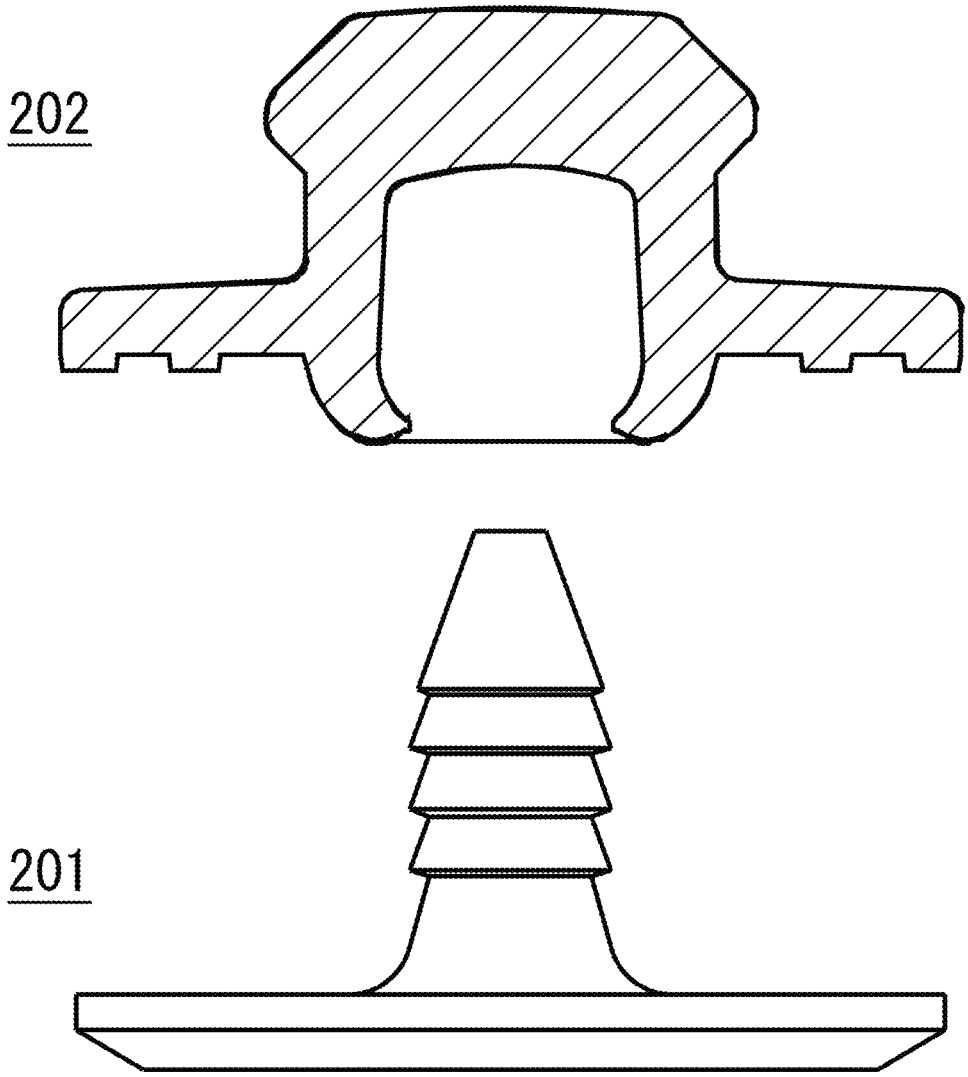
FIG. 6 is a reference diagram related to a method of attaching a male button to a fabric.

FIG. 1 is a schematic cross-sectional view of a female button 100 in unlocked state. Rotator 140 is at a first position and allows insertion and removal of a post 210 of a male button 200. FIG. 1 is a schematic cross-sectional view taken along the line I-I in FIG. 3. FIG. 2 is a schematic cross-sectional view of the female button 100 in locked state. The rotator 140 is at a second position and prohibits insertion and removal of the post 210 of the male button 200. FIG. 2 is a schematic cross-sectional view taken along the line II-II in FIG. 3. FIG. 3 is a diagram showing relative position of arresting parts 110 and elastic member 120 in a female button 100 in unlocked state. The elastic member 120 is provided radially outward than the arresting part 110 from the rotational axis of the rotator 140. The elastic member 120 allows radially outward displacement of the arresting parts 110. FIG. 4 is a diagram showing relative position of the arresting parts 110 and the elastic member 451 in the female button 100 in locked state. The elastic member 120 obstructs radially outward displacement of the arresting parts 110. FIG. 5 is a schematic cross-sectional view of a male button 200 used in combination with the female button 100. FIG. 6 is a reference diagram related to a method of attaching the male button 200 to a fabric 10.

The female button 100 may be configured from plural parts and may have various shapes and sizes. The rotator 140 is switched between first and second positions so that the female button 100 can be switched between unlocked and locked state. In some cases, in the circumferential direction around the rotational axis AX, the first position is a sole single location and the second position is a sole single location, but not necessarily limited to this. When the female button 100 is in unlocked state, the post 210 of the male button 200 (See FIGS. 5 and 6) can be inserted into the female button 100, and the post 210 of the male button 200 can be removed from the female button 100. When the female button 100 is in locked state, inserting the post 210 of the male button 200 into the female button 100 is hindered, and removing the post 210 of the male button 200 from female button 100 is also hindered. Employment of such female button 100 would allow one to find various effects in various fields. For example, in a nursing field, it might be possible to prevent those requiring nursing care and suffering dementia from freely taking off their clothes. For example, it might be possible to prevent a bag or a pouch or the like from opening, thus preventing fall of articles inside or increasing security. Other than this, various effects would be achievable in various fields.

As shown in FIG. 5, the male button 200 may have a post 210 and a base 220. The post 210 has a neck 211 and a head 212. The head 212 is radially expanded portion than the neck 211, and has an expanded portion 213 expanded radially outward. The base 220 is a portion for attachment to a fabric 10. FIG. 6 shows an example where the male button 200 is configured from a combination of a lower member 201 and an upper member 202. The fabric 10 is sandwiched between the lower member 201 and the upper member 202 so that attachment of the male button 200 to the fabric 10 is achieved.

As shown in FIGS. 1 and 2, the female button 100 may have a pair of arresting parts 110, an elastic member 120, a housing 130, a rotator 140 and a cap 150. The cap 150 may be provided for facilitating easier rotation of the rotator 140, not necessarily limited to this through. The cap 150 may be rotated by a hand so that the rotator 140 rotates around the rotational axis AX. In order to more surely present racing of the cap 150 relative to the rotator 140, the bottom surface of the cap 150 is provided with a projecting rotation stopper 150*m* at a radially outward position from the rotational axis AX. The top surface of the rotator 140 is provided with a recessed rotation stopper with which the projecting rotation stopper 150*m* is fitted. An embodiment is envisioned where the recessed rotation stopper is provided at the cap 150 and the projecting rotation stopper 150*m* is provided at the rotator 140. The cap 150 may be fixed to the rotator 140 through fitting or adhesive so as to be combined with the rotator 140.

In some cases, the cap 150 has a main body 151 and an outer peripheral portion 152. The main body 151 and the outer peripheral portion 152 may be made of the same material or different materials. For example, the main body 151 is made of metal, and outer peripheral portion 152 is made of resin. Sense of coolness given to fingertip when touching the outer peripheral portion 152 would be suppressed. Friction between the outer peripheral portion 152 and the fingertip would be increased, possibly facilitating the rotation of the cap 150, in turn the rotation of the rotator 140. The main body 151 is a circular plate-like part, and the outer peripheral portion 152 is a ring-like part. Example is envisioned where the main body 151 is a ring-like part. The outer peripheral portion 152 is provided with continuous or periodic projections and recesses along its circumferential direction, suppressing slip of fingertip on the external surface of the outer peripheral portion 152. Embodiment is envisioned where the cap 150 is omitted.

In some cases, the rotation of the cap 150 is supported by the housing 130. The cap 150 touches an upper plate 137*a* of a third metal member of the housing 130 described below. The rotation of the cap 150 is supported by the upper plate 137*a*, thus the rotation of the cap 150 is stabilized. In some cases, the outer peripheral portion 152 of the cap 150 has a skirt 152*r* extending downward toward the fabric 10. This suppresses that the cap 150 is taken off the fabric 10.

The housing 130 houses at least on pair of arresting parts 110 and the elastic member 12, and further houses a rotator 140 in some cases including the illustrated example. In some cases, the housing 130 allows attachment of the female button 100 to the fabric 10. The housing 130 has an opening OP5 into and from which the post 210 of the male button 200 is inserted and removed. The opening OP5 may have a circular shape that has a diameter that is equal to or greater than the maximum diameter of the head 212 of the post 210 of the male button 200. In some cases including the illustrated example, the housing 130 is configured from total three pieces of first to third metal members 131, 134, 137, but not necessarily limited to this.

The first metal member 131 is a tubular body of the housing 130. The first metal member 131 has a bottom portion 131*a* at which the opening OP5 is provided through which the post 210 of the male button 200 passes; a circumferential wall 131*b* upwardly extending from the periphery of the bottom portion 131*a*; and a rounded edge 131*c* rounded outward at the top end of the circumferential wall 131*b*. As would be understood from FIGS. 2-4, the coupling portion of the bottom portion 131*a* and the circumferential wall 131*b* is provided with a positioning protrusion 132 that is fitted with a positioning recess of the elastic member 120, allowing the elastic member 120 to be positioned on the first metal member 131. Two positioning protrusions 132 are symmetrically provided relative to the rotational axis AX, but another example is envisioned where one or two or more positioning protrusions are provided.

The second metal member 134 is a member for attaching the first metal member 131 to the fabric 10. The third metal member 137 is a member for closing the tubular body of the first metal member 131 from above, and is a member for attaching the first metal member 131 to the fabric 10. The second metal member 134 has a tubular wall 134*a* that extends along the circumferential wall 131*b* of the first metal member 131; a rounded edge 134*b* rounded radially outward at the top end of the wall 134*a*; and an annular lower plate 134*c* extending radially outward relative to the rotational axis AX from the bottom end of the wall 134*a*. The third metal member 137 has an annular upper plate 137*a* placed over the rounded edge 131*c* of the first metal member 131; and a bent edge 137*b* projecting radially outward from the periphery edge of the upper plate 137*a*. The inner portion of the upper plate 137*a* closer to the rotational axis AX is placed on the rotator 140. The arresting part 110, the elastic member 120, and the rotator 140 are held between the bottom portion 131*a* of the first metal member 131 and the upper plate 137*a* and the third metal member 137, and the arresting part 110, the elastic member 120, and the rotator 140 are housed in the housing 130. The rotator 140 has a projecting top 140*i* projecting from the upper plate 137*a* of the third metal member 137. The projecting top 140*i* is fitted with a circular opening provided at the upper plate 137*a*, stabilizing the rotation of the rotator 140.

In some cases including the illustrated example, metal pieces 15 are implanted in the fabric 10. The metal piece 15 is sandwiched between the bent edge 137*b* of the third metal member 137 and the lower plate 134*c* of the second metal member 134, resulting in increased attachment strength of the housing 130 to the fabric 10.

FIGS. 1 and 2 show plastically-processed first to third metal members 131, 134, 137. An example of a method of producing the female button 100 can be suggested as follows. The top end of the circumferential wall 131*b* of the first metal member 131, keen before being plastically deformed, penetrates through the fabric 10 and would thereafter be processed plastically so as to form the rounded edge 131*c*. The top end of the wall 134*a* of the second metal member 134, keen before being plastically deformed, penetrates through the fabric 10 and would thereafter be processed plastically so as to form the rounded edge 134*b*. The rounded edge 131*c* of the first metal member 131 and the rounded edge 134*b* of the second metal member 134 may be formed simultaneously. After the first metal member 131 and the second metal member 134 are attached to the fabric 10, the arresting part 110, the elastic member 120 and the rotator 140 are placed inside the first metal member 131. This is followed by placing the third metal member 137 on the rotator 140, and forming the bent edge 137*b* at the third metal member 137. Finally, the cap 150 is attached to the rotator 140. As such, the female button 100 may be produced. In a case where a pair of arresting parts 110 is used as an arresting part 110, an undivided annular part configured from the pair of arresting parts 110 combined to form an annular part is placed in the first metal member 131 and thereafter, in the first metal member 131, the annular part is divided into the pair of arresting parts 110 by a punching tool.

The arresting part 110 is a member for arresting the post 210 of the male button 200. In the female button 100, when the rotator 140 is at the first position (See FIGS. 1 and 3), radially outward displacement of the arresting part 110 of the rotator 140 is allowed; and when the rotator 140 is at the second position (See FIGS. 2 and 4), radially outward displacement of the arresting part 110 is hindered.

The elastic member 120 is arranged radially outward than the arresting part 110 relative to the rotational axis AX of the rotator 140. In the housing 130, the elastic member 120 is arranged radially outward than the arresting part 110, possibly facilitating that the arresting parts 110, having been moved away from the rotational axis AX by the head 212 of the post 210, are moved back closer to the rotational axis AX by the elastic member 120.

Figure 7:
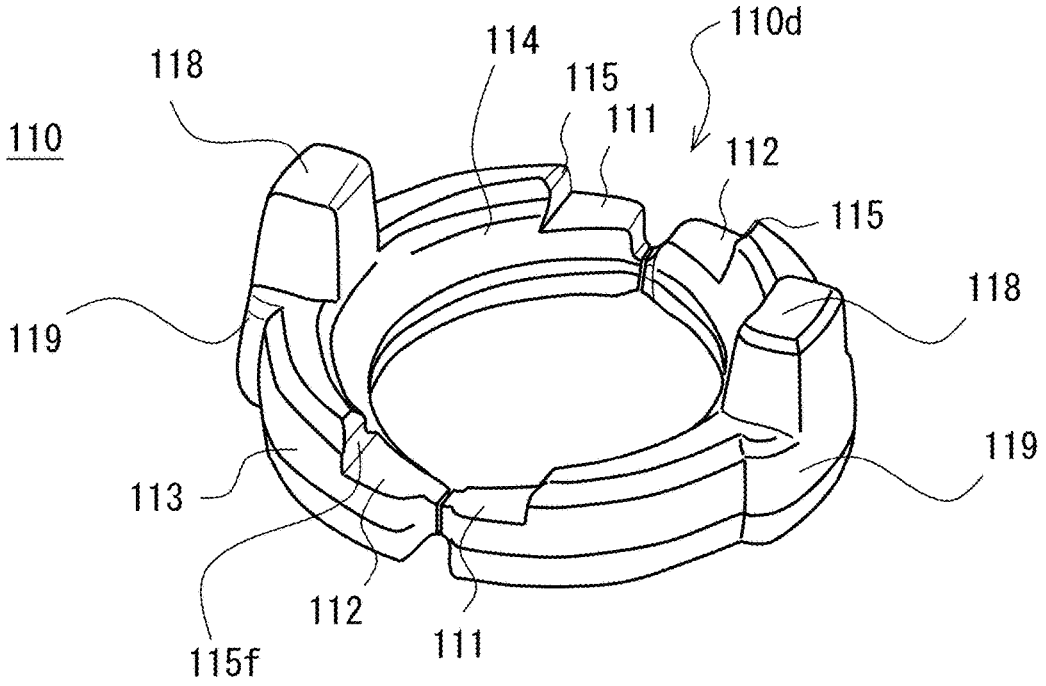
FIG. 7 is a schematic perspective view of arresting parts included in a female button according to a non-limiting aspect of the present disclosure. The female button has a pair of arresting parts for arresting a post as at least one arresting part. The pair of arresting parts is formed by division of an annular part which is a combined part of the pair of arresting parts.
Figure 8:
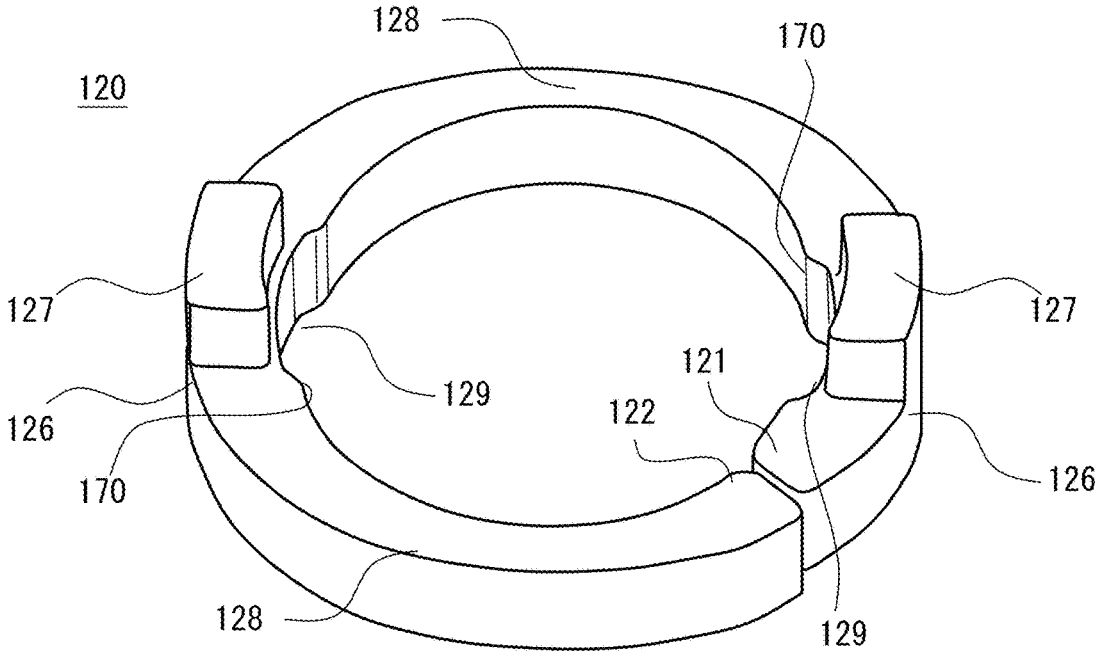
FIG. 8 is a schematic perspective view of an elastic member included in a female button according to a non-limiting aspect of the present disclosure. The elastic member is a resin-made spring. The elastic member has a thin portion extending in a circumferential direction around the rotational axis AX and being thinned radially with respect to the rotational axis AX so as to allow radially outward displacement of the arresting part in unlocked state.
Figure 9:
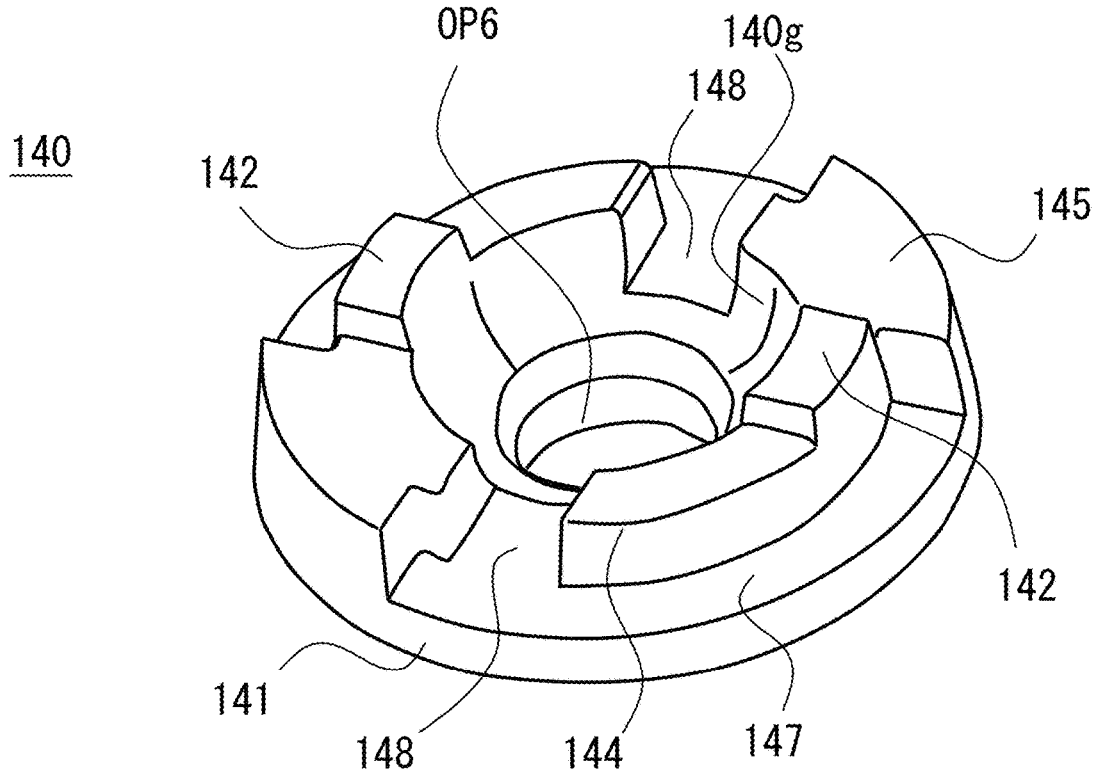
FIG. 9 is a schematic perspective view of rotator included in a female button according to a non-limiting aspect of the present disclosure. The bottom part of the rotator is viewed in perspective way, showing a structure for engagement with arresting parts and elastic member arranged below the rotator.
Figure 10:
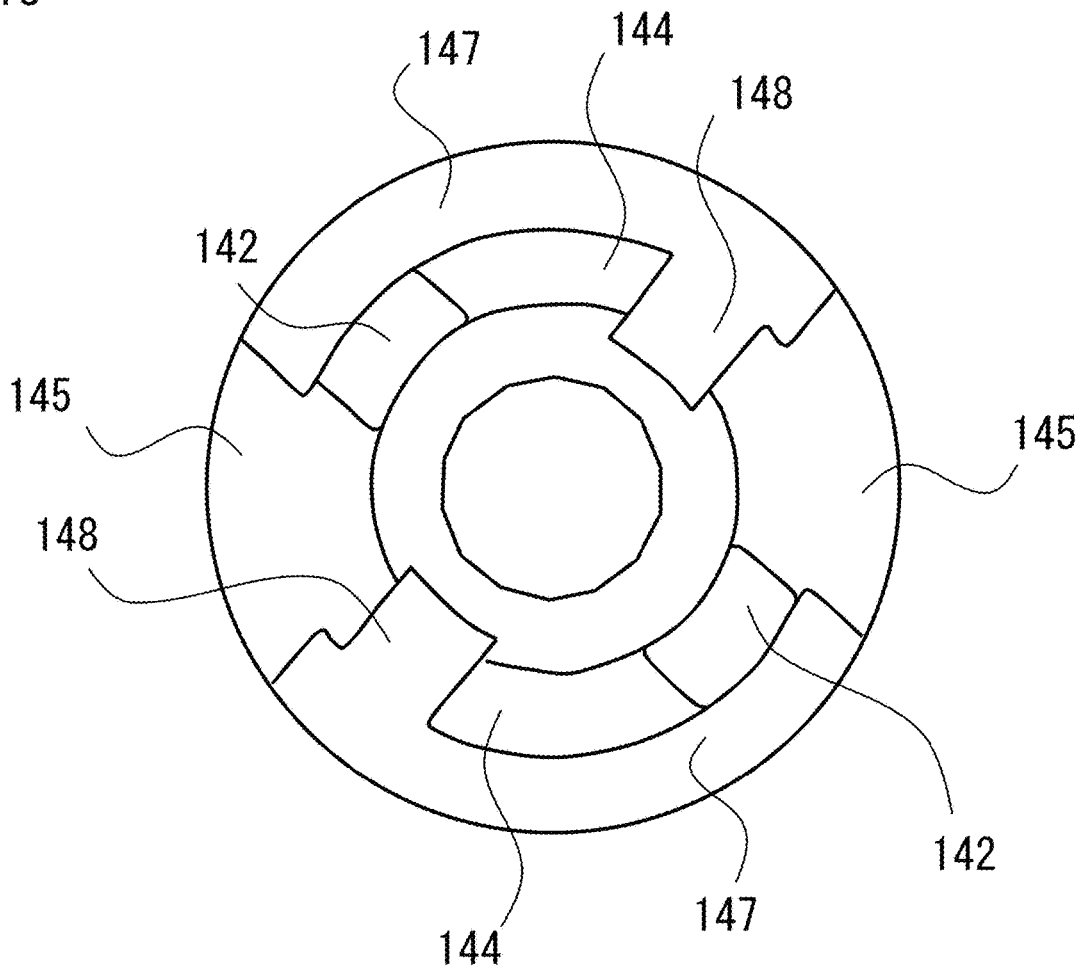
FIG. 10 is a schematic bottom elevational view of a rotator included in a female button according to a non-limiting aspect of the present disclosure.

With reference to FIGS. 7-10, the arresting part 110, the elastic member 120 and the rotator 140 will be further described in detail without intention of limiting. FIG. 7 is a schematic perspective view of arresting parts 110 included in the female button 100. The female button 100 has a pair of arresting parts 110, as at least one arresting part 110, for arresting the post 210. The pair of arresting parts 110 is formed by division of an annular part of combined pair of arresting parts 110, not necessarily limited to through. It would be apparent by just seeing broken ends of the arresting parts 110 whether the arresting part 110 is formed by division of the annular part 110. Embodiment is envisioned where only one of the pair of arresting parts 110 is movable radially. FIG. 8 is a schematic perspective view of an elastic member 120 included in the female button 100. The elastic member 120 is a resin-made spring. The elastic member 120 extends in the circumferential direction around the rotational axis AX, and has a thin portion 128 thinned radially regarding the rotational axis AX so as to allow radial outward displacement of the arresting parts 110 in unlocked state. FIG. 9 is a schematic perspective view of the rotator 140 included in the female button 100. The bottom part of the rotator 140 is perspectively viewed, and illustrated is an engagement structure provided at the bottom part of the rotator 140 for engagement with the arresting parts 110 and the elastic member 120. FIG. 10 is a schematic bottom elevational view of the rotator 140 included in the female button 100.

In some cases, the arresting part 110 extends in the circumferential direction around the rotational axis AX of the rotator 140. The arresting part 110 extends in an arc between first and second ends 111, 112. The arresting part 110 has a supporting face 114 that supports the head 212 of the post 210 of the male button 200. The supporting face 114 may be a slightly concave surface. The arresting part 110 has at least one first upward lug 118. In some cases, the respective ones of the pair of arresting part 110 has at least one first upward lug 118. The first upward lug 118 is fitted with a groove 148 (see FIGS. 9 and 10) of the rotator 140. The first upward lug 118 of the arresting part 110 is provided at a middle point of the circumferential length of the arresting part 110. Fitting of the first upward lug 118 and the groove 148 ensures co-operative operation of the rotator 140 and the arresting part 110, i.e. circumferential movement of the arresting part 110 based on rotation of the rotator 140.

The first and second ends 111, 112 of the arresting part 110 are thinned respectively in the up-down direction. The respective top surfaces of the first and second ends 111,112 is stepped down from the top surface of the intermediate portion 113 extending between the first and second ends 111, 112 of the arresting part 110. A step 115 is provided between the first end 111 and the intermediate portion 113, and a step 115 is provided between the second end 112 and the intermediate portion 113. Upward recess 110*d* is configured by adjacent ends 111,112 of the respective arresting parts 110 in the circumferential direction around the rotational axis AX. This upward recess 110*d* is fitted with the downward lug 142 of the rotator 140. The downward lug 142 is a fitting protrusion that will be fitted with the upward recess 110*d*. Fitting of the upward recess 110*d* and the downward lug 142 stabilizes the circumferential movement of the arresting parts 110 in accordance with the rotation of the rotator 140. In some cases, when the rotator 140 rotates, the downward lug 142 of the rotator 140 pushes the step 115, i.e. its step surface 115*f* extending in the up-down direction.

Each arresting part 110 may be a metal or resin member. Each arresting part 110 may be a part obtained through die casting or injection molding.

In some cases, the elastic member 120 extends in the circumferential direction around the rotational axis AX of the rotator 140. The elastic member 120 is a surrounding part that surrounds the arresting parts 110. The elastic member 120 is an annular member provided with a slit or a break. The elastic member 120 extends in the circumferential direction between the first and second ends 121, 122. The elastic member 120 has at least one second upward lug 127. In some cases including the illustrated example, a plurality of second upward lugs 127 are symmetrically arranged (with respect to the rotational axis AX). One of the second upward lugs 127 is positioned closer to the first end 121. The second upward lug 127 is not positioned closer to the second end 122. The second upward lug 127 is fitted with a passage 147 of the rotator 140 (See FIGS. 9 and 10). The rotator 140 is allowed to rotate in an amount that is in accordance with the circumferential length of the passage 147.

The elastic member 120 has a thick portion 126 thickened radially regarding the rotational axis AX so as to hinder radially outward displacement of the arresting part 110, when the female button 100 is in locked state. The elastic member 120 has a thin portion 128 thinned radially with respect to the rotational axis AX so as to allow radial outward displacement of the arresting parts 110 when the female button 100 is in unlocked state. One or more thick portions 126 and one or more thin portions 128 are provided at different positions in the circumferential direction of the elastic member 120.

A plurality (pair) of thick portions 126 may be provided corresponding to the plurality (pair) of arresting parts 110. A plurality (pair) of thin portions 128 may be provided corresponding to the plurality (pair) of arresting parts 110. Distance is increased between the outer and inner circumferential surfaces of the elastic member 120 as they extend in the circumferential direction so that the thick portion 126 is formed. The outer circumferential surface and the inner circumferential surface of the elastic member 120 come closer as extending in the circumferential direction, so that the thin portion 128 is formed. The top surface of the thick portion 126 is provided with the second upward lug 127. The bottom surface and the outer circumferential surface of the thick portion 126 is provided with a positioning recess with which the positioning protrusion 132 of the housing 130 is fitted.

In some cases including the illustrated example, the rotator 140 has at least one groove 148 to which the first upward lug 118 of the arresting part 110 is fitted, and an accommodating portion 140*g* that accommodates the head 212 of the post 210 of the male button 200. In one example, the groove 148 is in spatial communication with the space of the accommodating portion 140*g*, and extends radially outward from the space of the accommodating portion 140*g*. In another example, the groove 148 is not in spatial communication with the space of the accommodating portion 140*g*, and a wall is provided between them. The spatial communication between the groove 148 and the space may facilitate downsizing of the female button 100. A pair of the grooves 148 may be arranged symmetrically (relative to the rotational axis AX) corresponding to the first upward lugs 118 of the respective arresting parts 110 of the pair. In a case where three or more arresting parts 110 are provided, three or more grooves 148 may be provided.

In some cases, the rotator 140 is provided with the downward lug 142 to be fitted with the recess 110*d* configured by adjacent ends 111, 112 of respective arresting parts 110 in the circumferential direction around the rotational axis AX, not necessarily limited to this through. The effect thereof has been described above. In some cases, the downward lug 142 is provided at the center/middle between the two grooves 148 adjacent in the circumferential direction. In other words, the groove 148 is provided at the center/middle between the two downward lugs 142 adjacent in the circumferential direction.

Structure of the rotator 140 will be described in more detail without intention of limiting. The rotator 140 has an annular base 141 provided with an opening OP6 extending along the rotational axis AX, arc-shaped walls provided at the bottom surface of the annular base 141, and stoppers 145 provided at the bottom surface of the annular base 141. The annular base 141 may be formed in a circular plate not like an annular plate, and this may be simply referred to as a base. The arc-shaped wall 144 extends in the circumferential direction around the rotational axis AX. The plural (two) arc-shaped walls 144 configure the accommodating portion 140*g* that houses the (upper part of) head 212 of the post 210 of the male button 200. The bottom surface of the arc-shaped wall 144 is provided with the downward lug 142. The groove 148, with which the first upward lug 118 of the arresting part 110 is fitted, is provided between arc-shaped walls 144 adjacent in the circumferential direction.

When the rotator 140 and the respective arresting parts 110 are assembled, the arc-shaped wall 144 extends between the first upward lugs 118 of the arresting parts 110. The passage 147 extending circumferentially is positioned radially outward of the arc-shaped wall 144. The second upward lug 127 of the elastic member 120 is fitted with the passage 147. Degree of rotational of the rotator 140 is determined based on the circumferential length of the passage 147. The passage 147 is in spatial communication with the groove 148, thus possibly facilitating downsizing of the female button 100. The stopper 145 is provided radially outward of the arc-shaped wall 144, and is arranged adjacent to the passage 147 in the circumferential direction. The stopper 145 is a portion that collides with the second upward lug 127 of the elastic member 120, defining a limit of rotation of the rotator 140. Embodiment is envisioned where the stopper 145 is omitted and the passage 147 is continuous in the circumferential direction like a ring. Embodiment is envisioned where the second upward lugs 127 of the elastic member 120 are omitted and the passage 147 is omitted.

In some cases, the arresting part 110 has at least one engagement protrusion 119, and the elastic member 120 has at least one engagement recess 129 with which the engagement protrusion 119 is fitted. In some cases, the engagement protrusion 119 may be a radially outwardly protruding portion, and the engagement recess 129 may be a radially outwardly recessed portion. When the female button 100 is in locked state, the engagement protrusion 119 and the engagement recess 129 are fitted, thus preventing the locked state from being easily released. In some cases, the elastic member 120 is provided with a pair of engagement recesses 129 positioned and shaped symmetrically about the rotational axis AX.

In the present embodiment, the elastic member 120 is provided with a projection 170 which, when the rotator 140 rotates toward the second position, displaces the arresting part 110 toward the rotational axis AX before the rotator 140 reaches the second position. If the displacement of the arresting part 110 toward the rotational axis AX is obstructed by the post 210 of the male button 200, rotational resistance of the rotator 140 is increased. In a case where the rotational resistance of the rotator 140 is increased, an operator can have a tactile sense of locking that notifies that the female button 100 is in locked state. In a state where the post 210 of the male button 200 is not properly inserted into the female button 100, the arresting part 110 can move radially inward when being pushed by the projection 170. Thus, the rotational resistance of the rotator 140 is not increased and it is not possible for an operator to have the tactile sense of locking. In contrast, in a state where the post 210 of the male button 200 is properly inserted into the female button 100, displacement of the arresting part 110 due to the projection 170 is obstructed by the post 210 of the male button 200. The rotational resistance of the rotator 140 is increased and the force required to rotate the rotator 140 is increased. Accordingly, the operator can have the tactile sense of locking. It is avoided that the operator had the tactile sense of locking when the post 210 of the male button 200 was not inserted into the female button 100. The possibility of misunderstanding would be reduced that the female and male buttons 100, 200 are coupled even though they are uncoupled. The rotational resistance is a resistance caused when the rotator 140 is rotated circumferentially. When the rotational resistance is increased, a force required to rotate the rotator 140 would be greater than one before the rotational resistance is increased. When the rotational resistance is lowered, a force required to rotate the rotator 140 would be lower than one before the rotational resistance is lowered. The force required to rotate the rotator 140 may be referred as a replacement of the rotational resistance.

The projection 170 is a radially inwardly projecting portion, not necessarily limited to this through. The projection 170 touches the engagement protrusion 119 of the arresting part 110 and pushes the engagement protrusion 119 radially inward. The projection 170 is provided at the elastic member 120. The projection 170 is provided at the thick portion 126 of the elastic member 120. The projection 170 is provided adjacent to the engagement recess 129 in the circumferential direction. In some cases, at least one pair of projections 170 projecting radially inwardly are arranged to be opposed one another.

In some cases, the projection 170 may be projecting radially inwardly toward the rotational axis AX. Distance between the projections 170 and the rotational axis AX may change gradually in the circumferential direction around the rotational axis AX. For example, the distance between the projection 170 and the rotational axis AX would be smaller gradually, as approaching to the top of the projection 170 in the circumferential direction. The distance between the projection 170 and the rotational axis AX would be gradually greater, as moving away from the top of the projection 170 in the circumferential direction.

In unlocked state shown in FIG. 3, the engagement protrusion 119 is provided adjacent to the thin portion 128. The first end 111 of the arresting part 110 is provided adjacent to and radially inwardly of the thick portion 126. The second end 112 of the arresting part 110 is provided adjacent to and radially inward of the thick portion 126. The arresting part 110 being pushed radially outward by the post 210 pushes the thin portion 128 radially outward. When the thin portion 128 collides with the inner wall surface of the housing 130, the arresting part 110 is positioned sufficiently away from the rotational axis AX so that the head 212 of the post 210 can pass through an interspace between the arresting parts 110. The elastic member 120 pushes the arresting part 110 radially inwardly, and the head 212 of the post 210 is positioned onto the supporting faces 114 of the arresting parts 110. The top part of the head 212 of the post 210 is accommodated in the accommodating portion 140*g* of the rotator 140. Note that, as shown in FIG. 3, the pair of arresting parts 110 are arranged so as to define an oval-like opening OP7. The top view of the head 212 of the post 210 is a perfect circle. Without the radially outward movement of the arresting parts 110, the head 212 cannot pass through the interspace between the arresting parts 110.

At the locked state shown in FIG. 4, the engagement protrusion 119 and the engagement recess 129 are fitted one another. The first end 111 of the arresting part 110 is positioned radially inward of and adjacent to the thin portion 128. The second end 112 of the arresting part 110 is positioned radially inward of and adjacent to the thin portion 128. Even if it is attempted to pull out the post 210 of the male button 200 out of the female button 100 in locked state, the head 212 of the post 210 is arrested by the arresting parts 110 and thus pulling of the post 210 of the male button 200 out of the female button 100 is obstructed. Degree of radial outward displacement allowed by the arresting parts 110 is very small because of the thick portions 126 of the elastic member 120.

Figure 11:
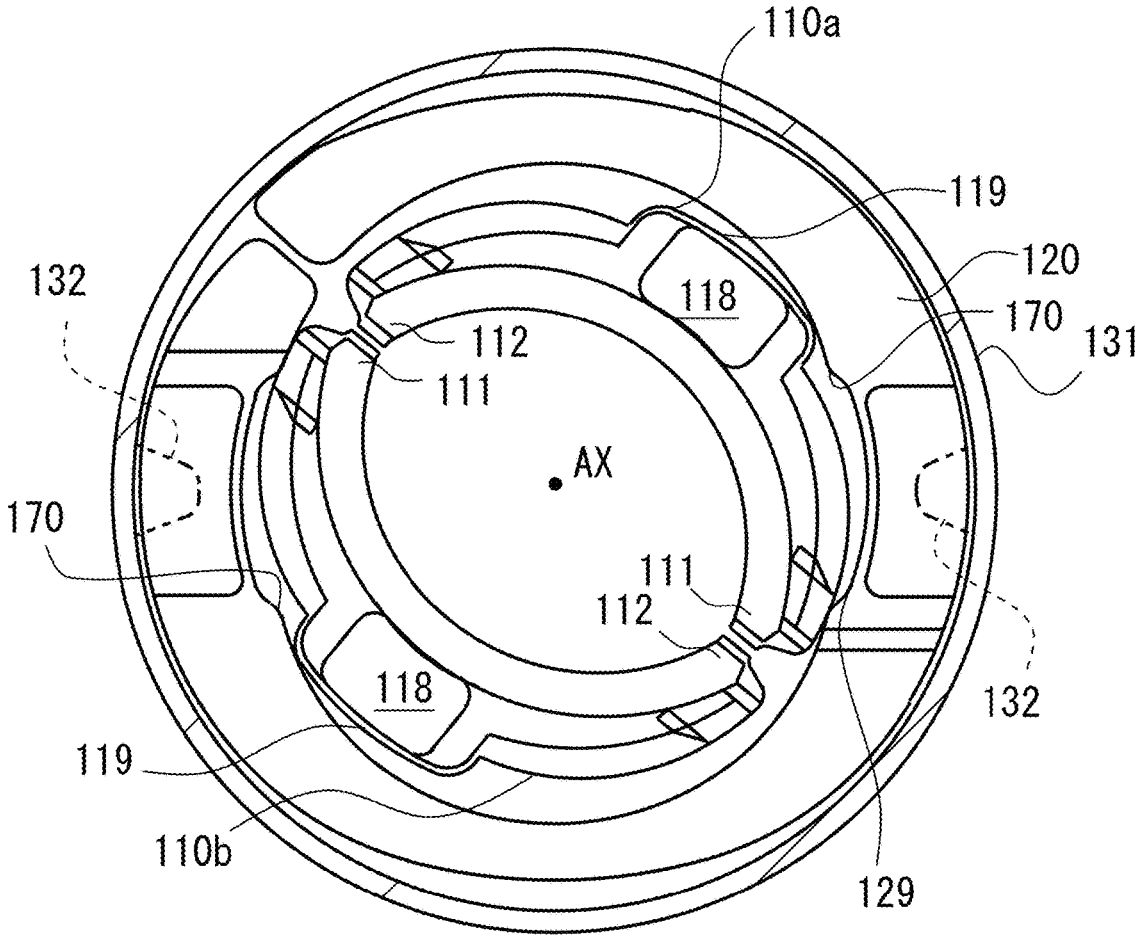
FIG. 11 is a view showing that, in a female button according to a non-limiting aspect of the present disclosure, when the rotator rotates toward the second position, arresting parts are pushed and moved toward the rotational axis by radially inwardly projecting projections provided on the elastic member before the rotator reaches the second position. Note that, when the rotator is at the second position, the female button is in locked state.
Figure 12:
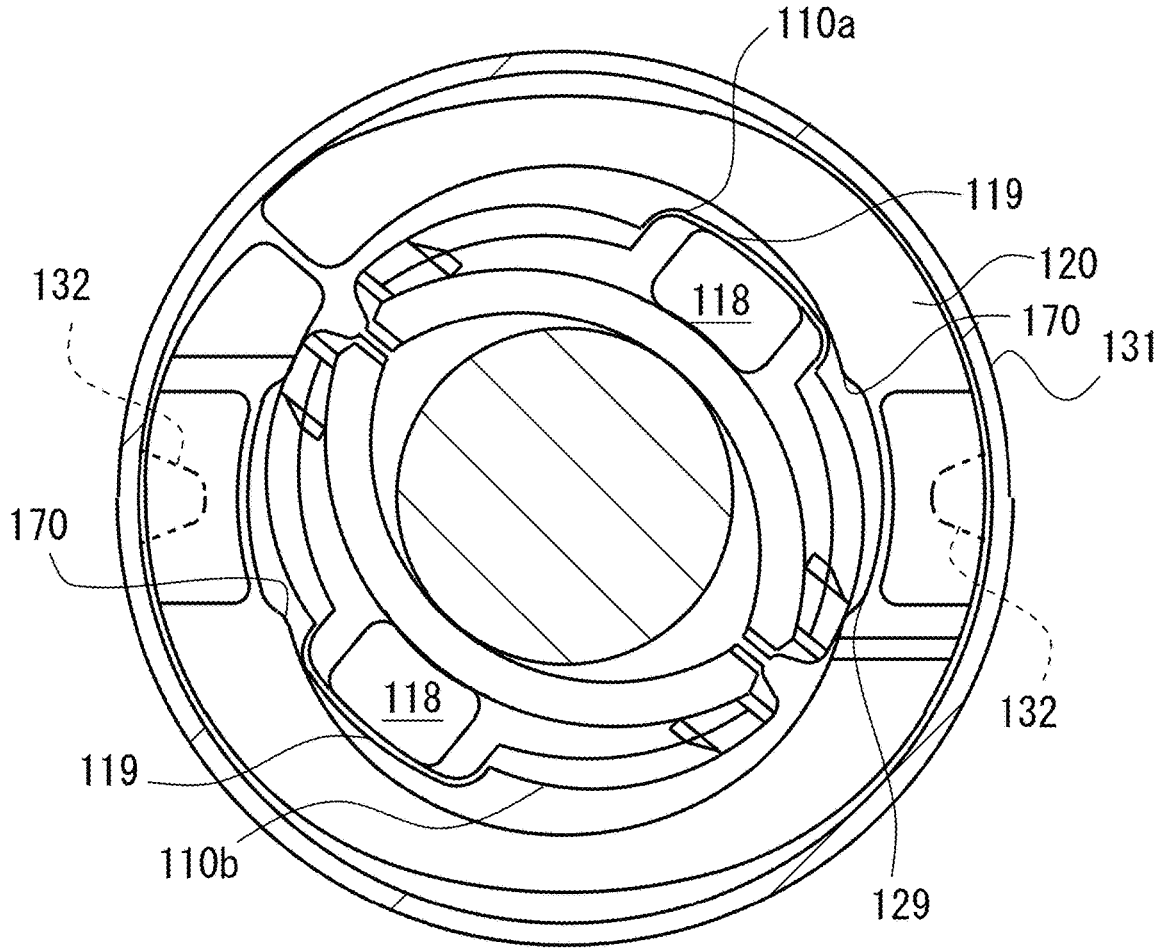
FIG. 12 is a view showing that, in a female button according to a non-limiting aspect of the present disclosure, when the rotator rotates toward the second position, arresting parts are pushed and moved toward the rotational axis by projections projecting radially inward and provided on the elastic member before the rotator reaches the second position, but this displacement of the arresting parts is obstructed by a post of a male button, resulting in increased rotational resistance of the rotator.

FIG. 11 is a view showing that, in the female button 100, when the rotator 140 rotates toward the second position, the arresting parts 110 are pushed and moved toward the rotational axis AX by radially inward projecting projections 170 provided on the elastic member 120 before the rotator 140 reaches the second position. Note that, when the rotator 140 is at the second position, the female button 100 is in locked state. FIG. 12 is a view showing that, in the female button 100, when the rotator 140 rotates toward the second position, the arresting parts are pushed and moved toward the rotational axis AX by projections 170 projecting radially inward and provided on the elastic member 120 before the rotator 140 reaches the second position, but this displacement of the arresting parts 110 is obstructed by the post 210 of the male button 200, resulting in increased rotational resistance of the rotator 140.

In FIG. 11, the arresting part 110 being pushed by the projection 170 can move radially inward, and the rotational resistance of the rotator 140 is not increased and the operator would have no tactile sense of locking. In FIG. 12, the arresting part 110 being pushed by the projection 170 cannot move radially inward by the post 210, and the rotational resistance of the rotator 140 is increased and the operator would be able to have the tactile sense of locking.

Figure 13:
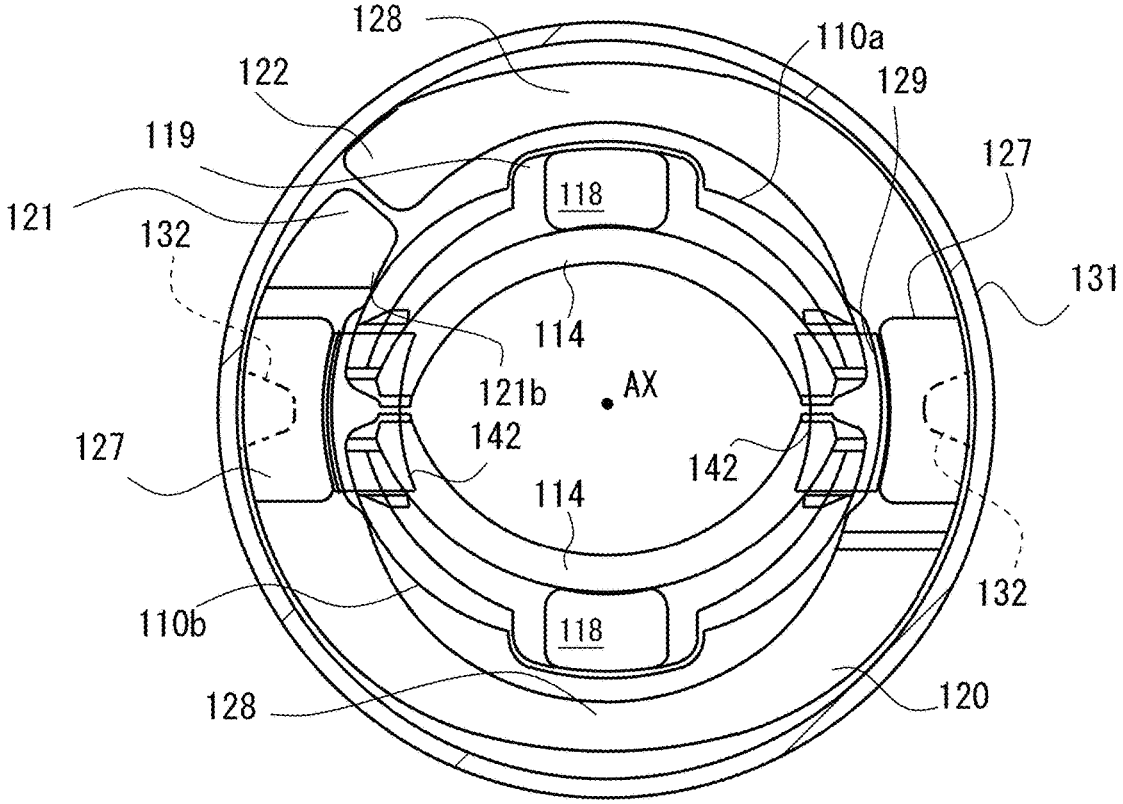
FIG. 13 is a diagram showing relative position of downward lugs provided at a rotator and an elastic member in a female button in unlocked state according to a non-limiting aspect of the present disclosure. The downward lug is fitted with an upward recess configured by adjacent ends of arresting parts in a circumferential direction around a rotational axis AX.
Figure 14:
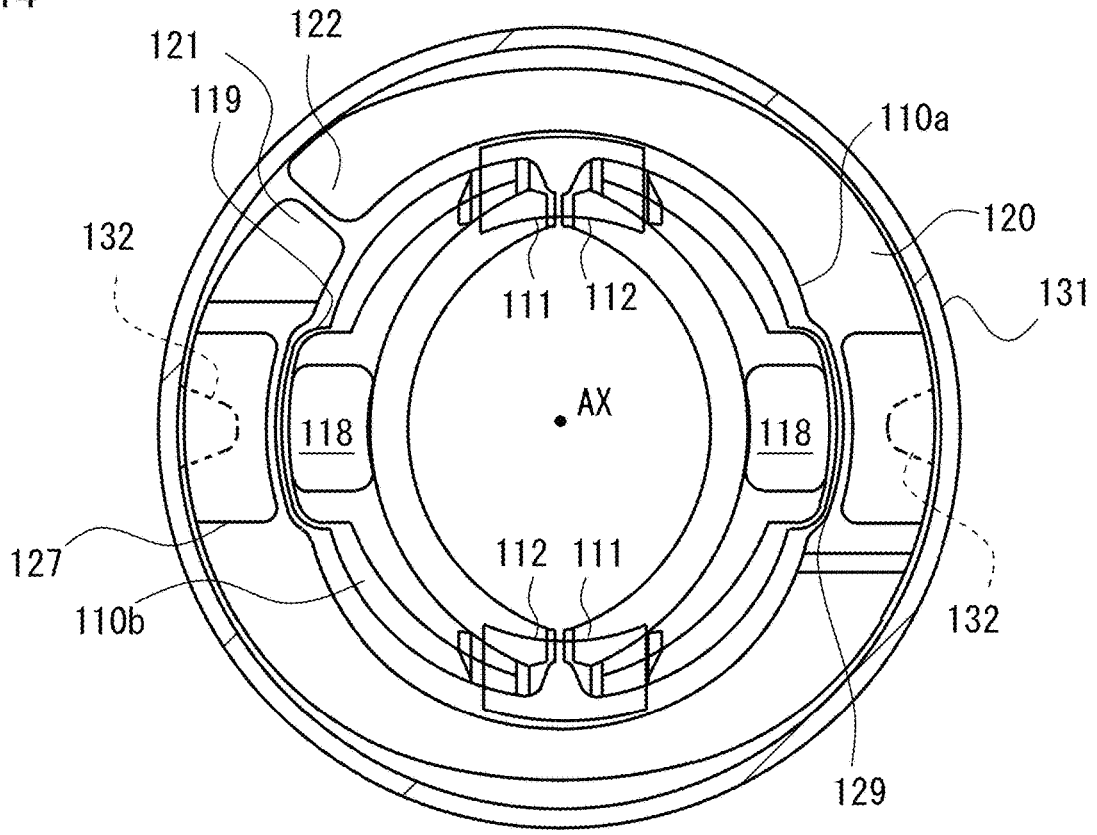
FIG. 14 is a diagram showing relative position of downward lugs provided at a rotator and an elastic member in a female button in locked state according to a non-limiting aspect of the present disclosure.
Figure 15:
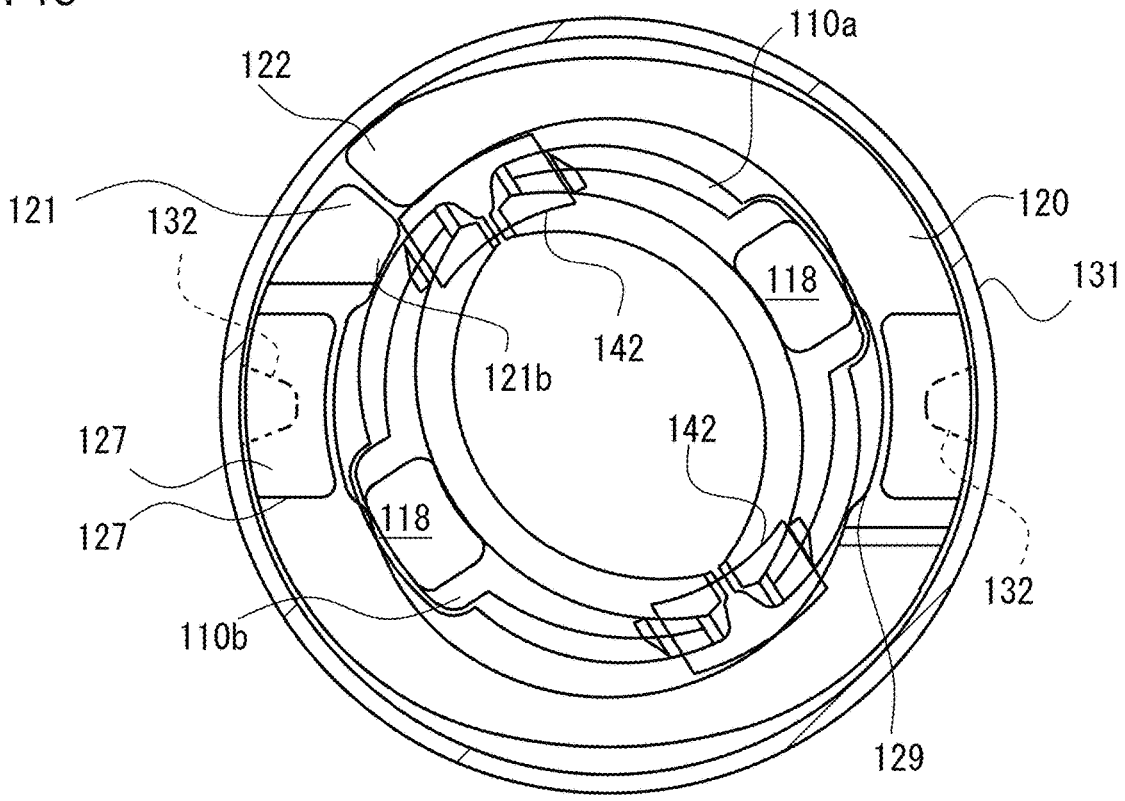
FIG. 15 is a view showing that, in a female button according to a non-limiting aspect of the present disclosure, when the rotator rotates toward the first position, downward lugs push an elastic member radially outward regarding a rotational axis before the rotator reaches the first position. Note that, when the rotator is at the first position, the female button is in unlocked state.

FIG. 13 is a diagram showing relative position of downward lugs 142 provided at the rotator 140 and the elastic member 120 in the female button 100 in unlocked state. FIG. 14 is a diagram showing relative position of downward lugs 142 provided at the rotator 140 and the elastic member 120 in the female button 100 in locked state. FIG. 15 is a view showing that, in the female button 100, when the rotator 140 rotates toward the first position, the downward lugs 142 push the elastic member 120 radially outward regarding the rotational axis before the rotator 140 reaches the first position. Note that, when the rotator 140 is in the first position, the female button 100 is in unlocked state.

In some cases, the rotational resistance of the rotator 140 is increased before the rotator 140 reaches the first position when the rotator 140 rotates toward the first position. The rotational resistance of the rotator 140 is increased when the rotator 140 is rotated to the first position so that the operator is notified of the unlocking position and convenience of use of the female button 100 would be enhanced.

In some cases, when the rotator 140 rotates toward the first position, the downward lugs 142 of the rotator 140 pushes the elastic member 120 radially outward regarding the rotational axis AX before the rotator 140 reaches the first position. The operator can be notified of the unlocking position of the rotator 140 based on the use of existing parts such as the rotator 140 and the elastic member 120.

When the rotator 140 is returned from the second position back to the first position, the downward lugs 142 pass by the ends 121, 122. When the downward lugs 142 passes by radially inward position of the ends 121, 122 of the elastic member 120, the downward lugs 142 push the ends 121, 122 of the elastic member 120 radially outward. Accordingly, the rotational resistance of the rotator 140 is increased and the operator can be notified of the unlocking position of the rotator 140.

In some cases, the first end 121 of the elastic member 120 is provided with expanded portion 121*b* expanded radially inward. When the rotator 140 returns back to the first position, the downward lug 142 of the rotator 140 pushes radially outwardly the expanded portion 121*b* at the first end 121 of the elastic member 120. After the downward lug 142 passes the expanded portion 121*b*, the first end 121 of the elastic member 120 may be moved back to a radially inward initial position.

As states at the beginning, the illustrated example includes a plurality of individual features, and each feature may be understood as an independent one feature. The feature of the increased rotational resistance of the rotator 140 before the rotator 140 reaches the first position when the rotator 140 rotates toward the first position would be understood as an additional invention or possibly as an independent invention from the feature that a tactile sense of locking is not given when the post 210 is not inserted. The same applies to other independent features. Note that, the projection 170 may be a combined or separated part with the elastic member 120.

Figure 16:
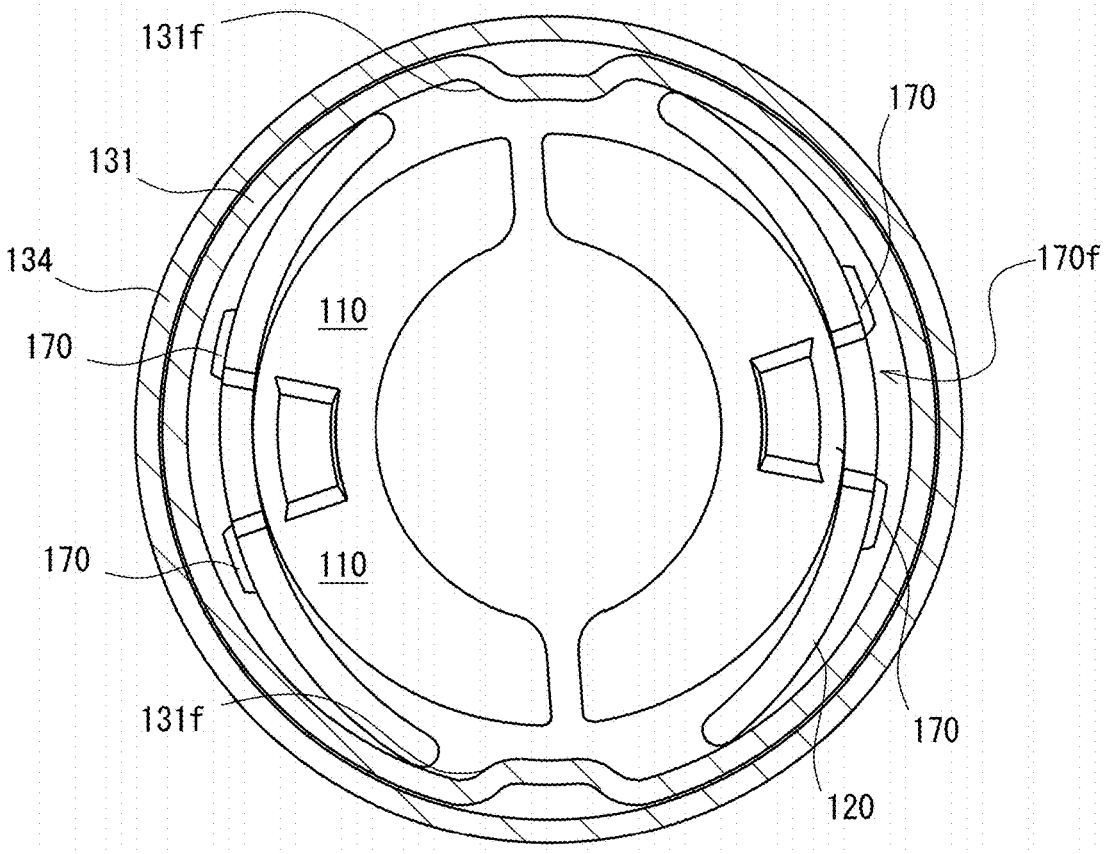
FIG. 16 is a diagram showing that, in a female button in unlocked state according to another non-limiting aspect of the present disclosure, a projection provided at an elastic member is projecting radially outward. In accordance with rotation of a rotator, the arresting parts and the elastic member are moved in a circumferential direction around a rotational axis. The elastic member is a metal-made or resin-made spring plate. Inner wall of a housing that accommodates the arresting parts and the elastic member is provided with engagement protrusions protruding radially inward.
Figure 17:
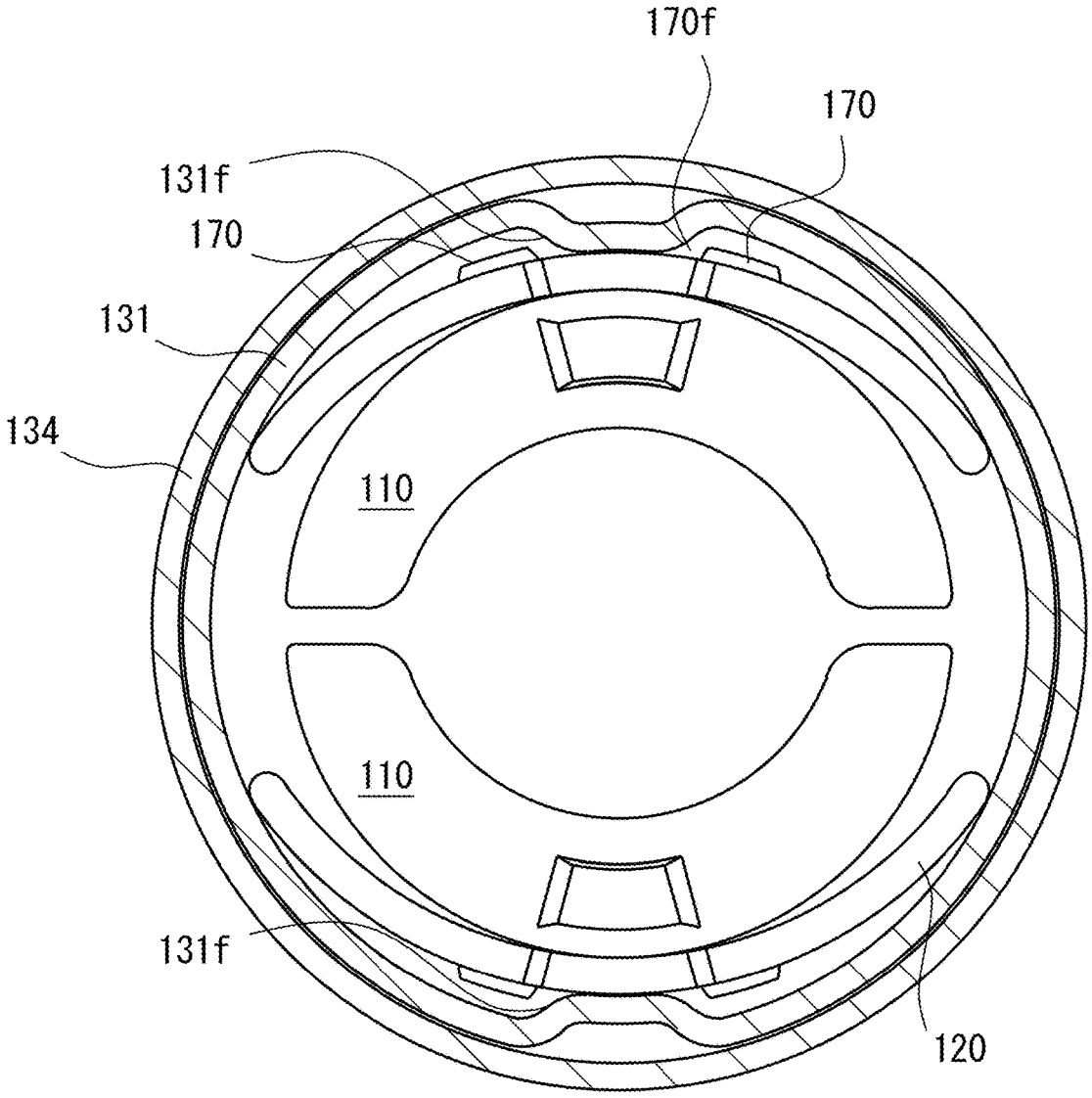
FIG. 17 is a diagram showing locked state of a female button of FIG. 16.
Figure 18:
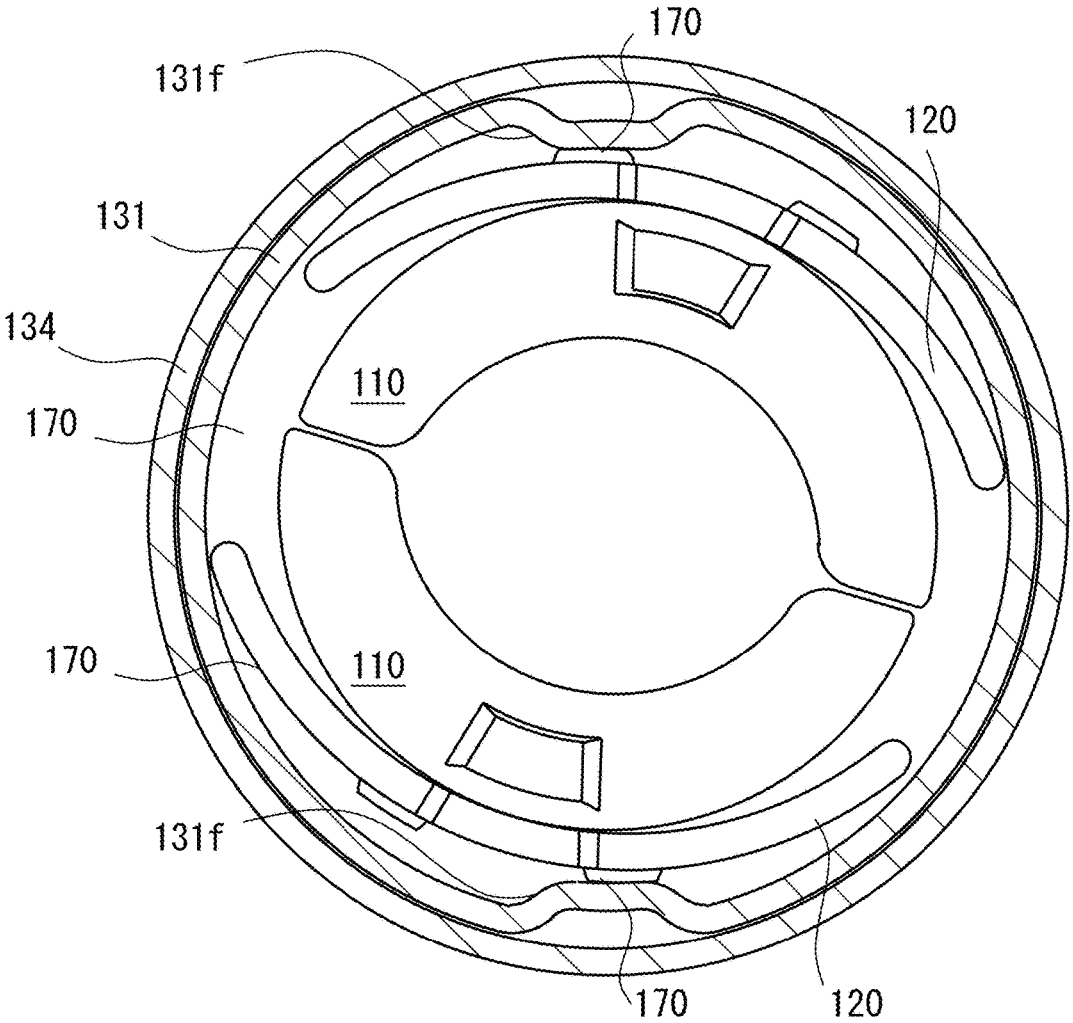
FIG. 18 is a diagram showing that, in a female button of FIG. 16, when a rotator rotates towards a second position, arresting parts are moved toward a rotational axis due to projections projecting radially outward and provided in elastic members before the rotator reaches the second position. Note that, when the rotator is at the second position, the female button is in locked state.
Figure 19:
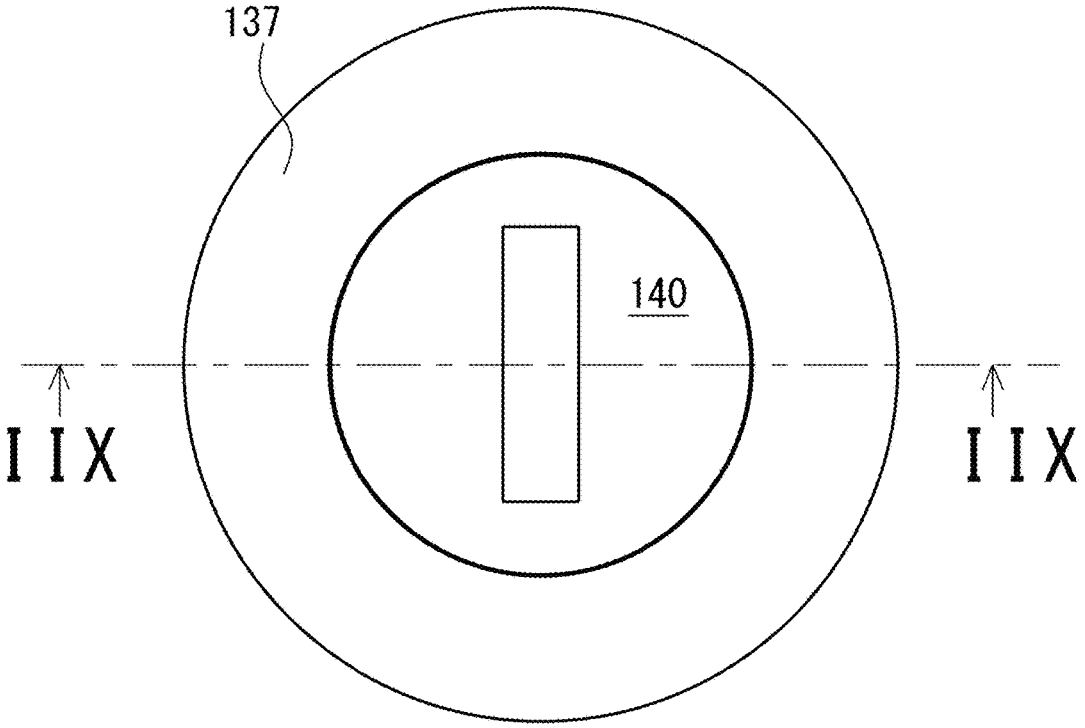
FIG. 19 is a schematic top view of a female button of FIG. 16.
Figure 20:
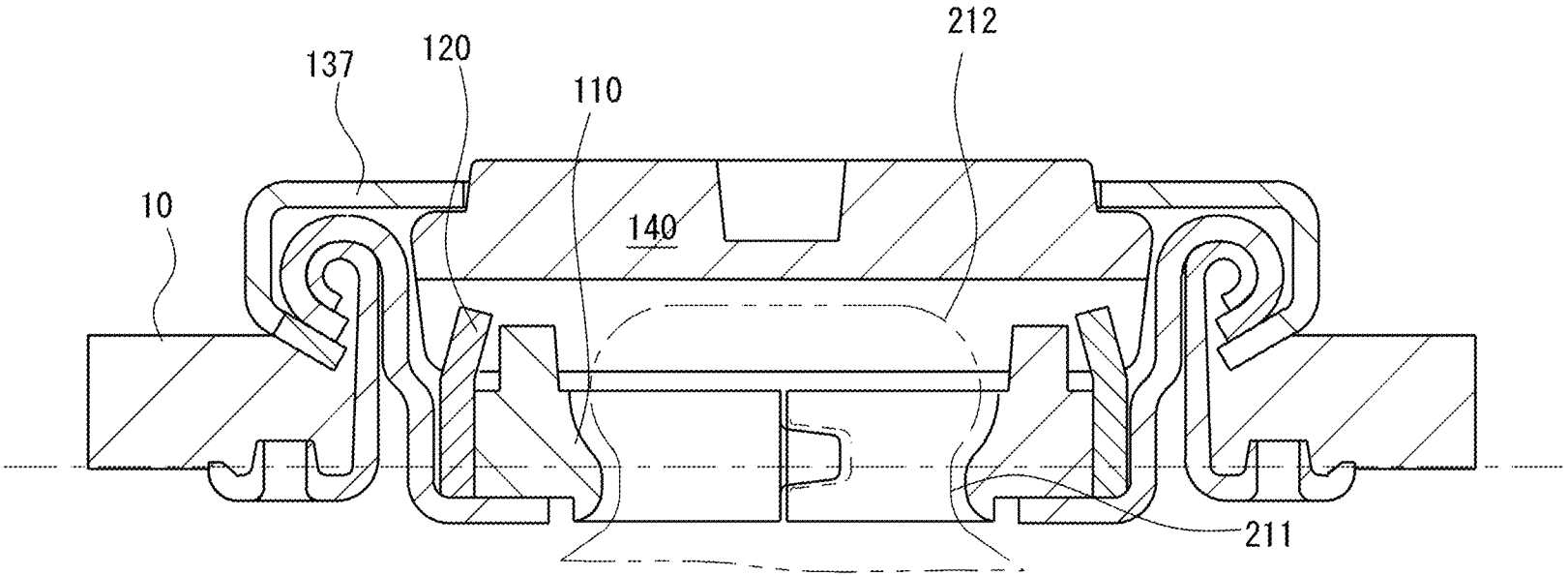
FIG. 20 is a schematic cross-sectional view of a female button taken along the line IIX-IIX in FIG. 19.
Figure 21:
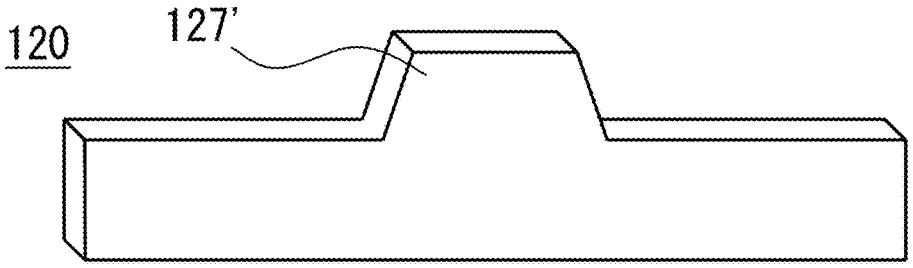
FIG. 21 is a schematic perspective view of an elastic member of a female button of FIG. 16.
Figure 22:
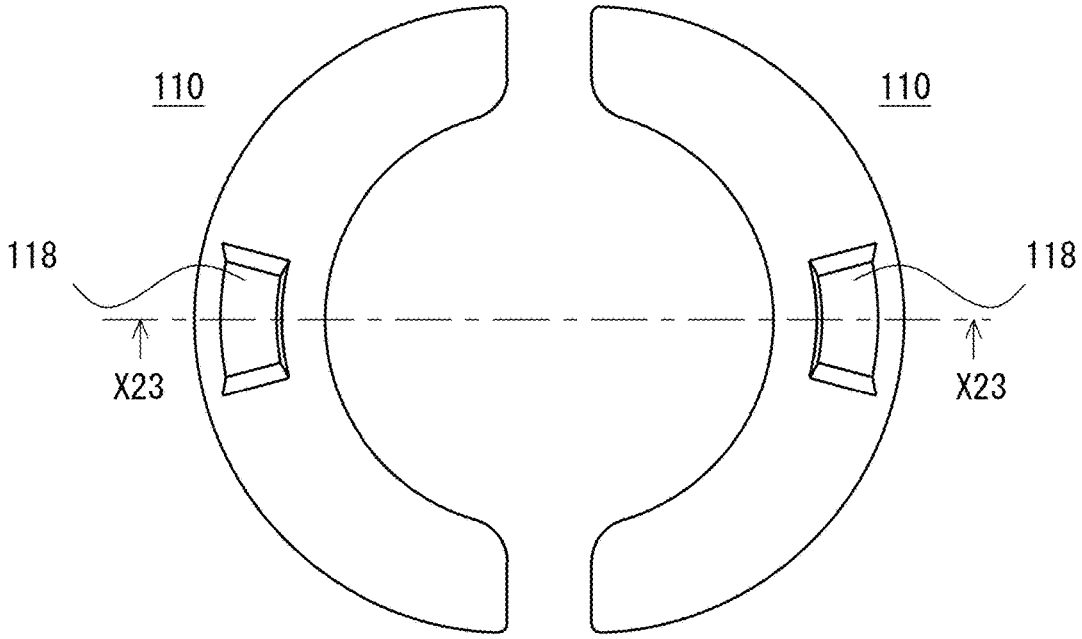
FIG. 22 is a schematic top view of arresting parts of a female button of FIG. 16.
Figure 23:
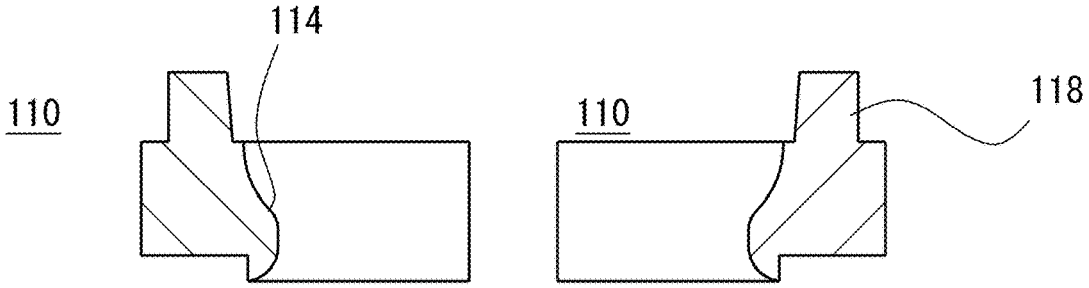
FIG. 23 is a schematic cross-sectional view of arresting parts taken along the line X23-X23 in FIG. 22.

Hereinafter, another example will be described where a projection 170 is provided at the elastic member 120 and is radially outwardly projecting from the elastic member 120. FIG. 16 is a diagram showing that, in the female button 100 in unlocked state, the projection 170 provided at the elastic member 120 is projecting radially outward. In accordance with rotation of the rotator 140, the arresting parts 110 and the elastic member 120 are moved in the circumferential direction around the rotational axis AX. The elastic member 120 is a metal-made or resin-made spring plate. Inner wall of the housing 130 housing the arresting parts 110 and the elastic member 120 is provided with engagement protrusions 131*f* protruding radially inward. FIG. 17 is a diagram showing locked state of the female button of FIG. 16. FIG. 18 is a diagram showing that, in the female button 100 of FIG. 16, when the rotator 140 rotates towards the second position, the arresting parts are moved toward the rotational axis AX due to projections 170 projecting radially outward and provided at the elastic members 120 before the rotator 140 reaches the second position. Note that, when the rotator is at the second position, the female button is in locked state. Note that, when the rotator 140 is at the second position, the female button 100 is in locked state. FIG. 19 is a schematic top view of the female button of FIG. 16. FIG. 20 is a schematic cross-sectional view of the female button taken along the line IIX-IIX in FIG. 19. FIG. 21 is a schematic cross-sectional view of the female button of FIG. 16. FIG. 21 is a schematic perspective view of the elastic member of the female button of FIG. 16. FIG. 22 is a schematic top view of arresting parts of the female button of FIG. 16. FIG. 23 is a schematic cross-sectional view of arresting parts taken along the line X23-X23 in FIG. 22.

As would be apparent from FIGS. 16 to 23, similar effect would be obtained in the case where the projection 170 is projecting radially outward as the case where the projection 170 is projecting radially inward. As would be particularly understood from FIGS. 16-18, the elastic member 120 is provided with the projection 170 that displaces the arresting part 110 towards the rotational axis AX before the rotator 140 reaches the second position, when the rotator 140 rotates towards the second position. If the displacement of the arresting part 110 toward the rotational axis AX is obstructed by the post 210 of the male button 200, the rotational resistance of the rotator 140 would be increased.

In some cases, the projection 170 is provided on the outer circumferential surface of the elastic member 120. In some cases, a pair of projections 170 is provided on the outer circumferential surface of the elastic member 120, and the pair of projections 170 configures the engagement recess 170*f*. In the locked state, the engagement protrusion 131*f* provided on the inner wall surface of the housing 130 engage the engagement recess 170*f* configured by the pair of projections 170. As such, easier releasing of locked state would be suppressed.

In some cases, the elastic member 120 is a spring plate, e.g. metal-made spring plate. The spring plate before housed in the housing 130 may be linear as shown in FIG. 21. After the spring plate is housed in the housing 130, then the spring plate would be curved in an arc. The elastic member 120 is directly or indirectly coupled with or uncoupled with the arresting part 110. The upward lug 118 of the arresting part 110 and the upward lug 127' of the elastic member 120 may be fitted with the grooves of the rotator 140. In accordance with rotation of the rotator 140, the arresting part 110 and the elastic member 120 may be moved in the circumferential direction. The top surface of the rotator 140 may be provided with a recess with which a jig, e.g. flat-head screwdriver is fitted. The rotator 140 may be rotated by the jig. As would be understood from FIGS. 16-23, respective configurations and interrelationship of the arresting part 110 and the elastic member 120 may be variously modified. The projection 170 may be a metal or resin portion. The projection 170 may be integral with or separated from the elastic member 120.

Figure 24:
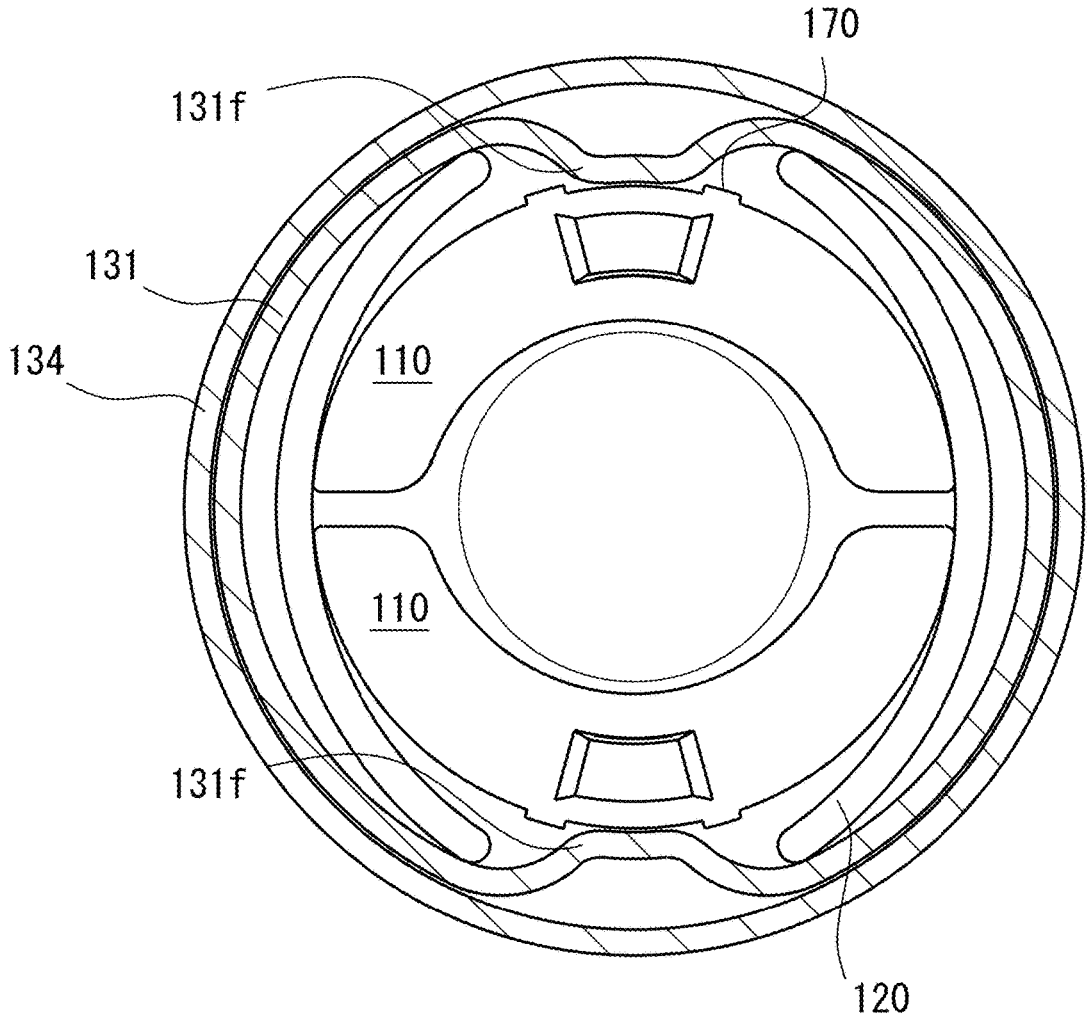
FIG. 24 is a diagram showing that, in a female button in locked state according to another non-limiting aspect of the present disclosure, a projection is provided at an arresting part and is projecting radially outward. In accordance with rotation of a rotator, the arresting parts are moved in a circumferential direction around a rotational axis. The elastic member is a metal-made or resin-made spring plate, and does not move around the rotational axis in accordance with rotation of the rotator. Inner wall of a housing that accommodates the arresting parts and the elastic member is provided with engagement protrusions protruding radially inward.

Hereinafter, another example will be described where the projection 170 is provided at the arresting part 110. FIG. 24 is a diagram showing that, in the female button 100 in locked state, the projection 170 is provided at the arresting part 110 and is projecting radially outward. In accordance with rotation of the rotator 140, the arresting parts 110 are moved in the circumferential direction around the rotational axis AX. The elastic member 120 is a metal-made or resin-made spring plate, and does not move around the rotational axis AX in accordance with rotation of the rotator 140.

As apparent from FIG. 24, similar effect would be obtained in the case where the projection 170 is provided at the arresting part 110 as the case where the projection 170 is provided at the elastic member 120. As would be understood from FIG. 24, the arresting part 110 is provided with the projection 170 that displaces the arresting part 110 toward the rotational axis AX before the rotator 140 reaches the second position, when the rotator 140 rotates toward the second position. If the displacement of the arresting part 110 toward the rotational axis AX is obstructed by the post 210 of the male button 200, the rotational resistance of the rotator 140 would be increased.

Based on the above teaching, a skilled person in the art would be able to add various modifications to the respective embodiments. Reference numerals in Claims are just for reference and should not be referred for the purpose of narrowly construing the scope of claims.

REFERENCE SIGNS LIST

100 Female button
200 Male button
210 Post
211 Neck
212 Head
110 Arresting part
120 Elastic member
130 Housing
140 Rotator
170 Projection

The invention claimed is:

1. A female button which is in an unlocked state when a rotator takes a first position and which is in a locked state when the rotator takes a second position, insertion and removal of a post of a male button being allowed in the unlocked state, and insertion and removal of the post of the male button being hindered in the locked state, the female button comprising:

at least one arresting part configured to arrest the post of the male button moving along a rotational axis of the rotator away from the female button, wherein radially outward displacement of the arresting part relative to the rotational axis of the rotator being allowed when the rotator takes the first position, and radially outward displacement of the arresting part relative to the rotational axis of the rotator is hindered when the rotator takes the second position; and at least one elastic member arranged radially outward of the at least one arresting part with respect to the rotational axis of the rotator, wherein the arresting part or the elastic member is provided with a projection which, when the rotator rotates toward the second position, displaces the arresting part toward the rotational axis before the rotator reaches the second position and, if the displacement of the arresting part toward the rotational axis is obstructed by the post, rotational resistance of the rotator is increased, and wherein said increase of the rotational resistance of the rotator depends on whether the post has been inserted into the female button or not.

2. The female button according to claim 1, wherein when the rotator rotates toward the first position, the rotational resistance of the rotator is increased before the rotator reaches the first position.

3. The female button according to claim 1, wherein a plurality of arresting parts configured to arrest the post is provided as the at least one arresting part.

4. The female button according to claim 1, wherein the first position includes a single location only in a circumferential direction around the rotational axis, and the second position includes a single location only in the circumferential direction around the rotational axis.

5. The female button according to claim 3, wherein the rotator has a fitting protrusion that is fitted with a recess configured by adjacent ends of the arresting parts in a circumferential direction around the rotational axis.

6. The female button according to claim 5 wherein, when the rotator rotates toward the first position, the fitting protrusion pushes the elastic member radially outward before the rotator reaches the first position.

7. The female button according to claim 1, wherein the arresting part has at least one engagement protrusion, and the elastic member has at least one engagement recess with which the engagement protrusion is fitted when the rotator is at the second position.

8. The female button according to claim 7, wherein the projection is provided adjacent to the engagement recess.

9. The female button according to claim 1, wherein the elastic member has a thin portion extending in a circumferential direction around the rotational axis and being thinned radially with respect to the rotational axis so as to allow radially outward displacement of the arresting part in the unlocked state.

10. The female button according to claim 1, wherein a pair of arresting parts configured to arrest the post is provided as the at least one arresting part.

11. The female button according to claim 10, wherein the rotator is fitted with adjacent ends of the arresting parts in a circumferential direction around the rotational axis.

12. The female button according to claim 10, wherein the pair of arresting parts is formed by division of an annular part which is a combined part of the pair of arresting parts.

13. A set of buttons comprising:

a female button according to claim 1; and a male button that has a post to be arrested by the arresting part of the female button.

14. A female button comprising:

a housing that comprises a bottom having an opening through which a post of a male button is inserted;

a rotator at least partially housed in the housing and arranged over the bottom of the housing, said rotator being rotatable about a rotational axis between unlocking and locking positions;

a least one arresting part arranged between the bottom of the housing and the rotator and coupled with the rotator such that the arresting part move about the rotational axis of the rotator as the rotator rotates about the rotational axis, said arresting part being configured to arrest the post of the male button moving along the rotational axis of the rotator away from the female button;

at least one elastic member arranged between the bottom of the housing and the rotator and arranged radially outward of the arresting part with respect to the rotational axis of the rotator, wherein when the rotator is at the unlocking position and the post of the male button is to be inserted into the female button through the opening of the housing, said arresting part moves radially outward as being pushed by the post so that the post is inserted into the female button, and when the rotator is at the locking position and the post of the male button is to be pulled out from the female button through the opening of the housing, said arresting part is pushed by the post radially outward but is hindered to move in this direction so that the post is prevented from being pulled out from the female button, and wherein the arresting part or the elastic member is provided with a projection which, when the rotator rotates toward the locking position, displaces the arresting part toward the rotational axis before the rotator reaches the locking position, and, if displacement of the arresting part toward the rotational axis is obstructed by the post, rotational resistance of the rotator is increased, said increase of the rotational resistance of the rotator being dependent on whether the post as been inserted into the female button or not.

15. The female button of claim 14, wherein the arresting part comprises an engagement protrusion protruding radially outward of the rotational axis of the rotator, and the elastic member comprises an engagement recess recessed radially outward of the rotational axis of the rotator, and wherein when the rotator is at the locking position, the engagement protrusion and the engagement recess are engaged one another.

16. The female button of claim 15, wherein the projection is located adjacent to the engagement recess.

17. The female button of claim 14, wherein a single elastic member is housed in the housing and the elastic member is configured to extend about the rotational axis of the rotator to have an annular shape with a single slit or break.

18. The female button of claim 17, wherein the elastic member has at least one thin portion which allows radially outward movement of the arresting part.

* * * * *